United States Patent [19]

Smith

[11] Patent Number: 4,589,843

[45] Date of Patent: May 20, 1986

[54] INFRA-RED IRRADIATION

[76] Inventor: Thomas M. Smith, 1415 Golf Rd., Cinnaminson, N.J. 08077

[21] Appl. No.: 628,989

[22] Filed: Jul. 9, 1984

Related U.S. Application Data

[63] Continuation-in-part of Ser. No. 592,793, Mar. 23, 1984, and a continuation-in-part of Ser. No. 567,270, Dec. 30, 1983, abandoned, and a continuation-in-part of Ser. No. 509,161, Jun. 29, 1983, Pat. No. 4,500,283, and a continuation-in-part of Ser. No. 435,412, Oct. 20, 1982, abandoned, and a continuation-in-part of Ser. No. 292,167, Aug. 12, 1981, Pat. No. 4,474,552.

[51] Int. Cl.[4] ..... F27B 9/28; F23N 5/00; C21D 9/52

[52] U.S. Cl. ..... 432/59; 266/102; 431/33

[58] Field of Search ..... 432/8, 59; 431/32, 33; 266/102

[56] References Cited

U.S. PATENT DOCUMENTS 3,984,197 10/1976 Birke et al. ..... 432/8
4,272,237 6/1981 Smith ..... 431/328

*Primary Examiner*—John J. Camby
*Attorney, Agent, or Firm*—Connolly and Hutz

[57] ABSTRACT

Improved techniques for infra-red generating gas-fired burners to heat-treat substrates with or without the added heating effects of the hot combusted gases generated by the burners. Burners can have ceramic fiber mat held over shallow combustion mixture plenum essentially completely spanned by baffle. Mats can have folded-in edges to permit close packing. Plenum can have partition forming small ignition compartment with igniter against covering portion of mat.

4 Claims, 37 Drawing Figures

Fig. 9.
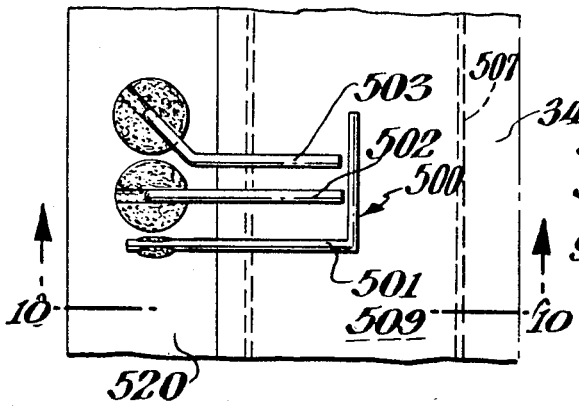
Fig. 13.
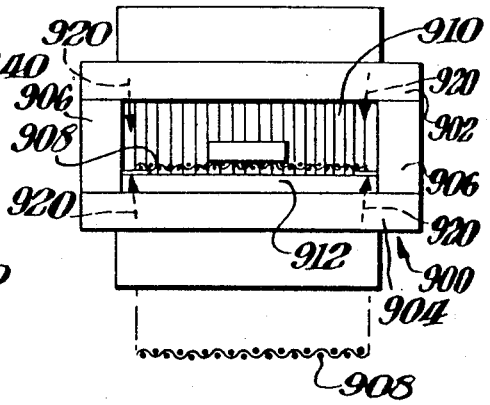
Fig. 10.
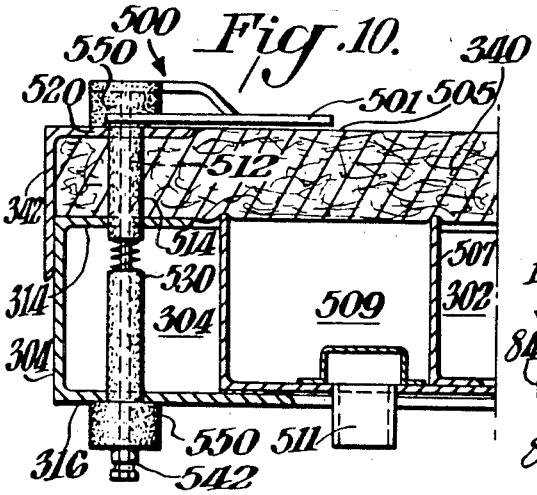
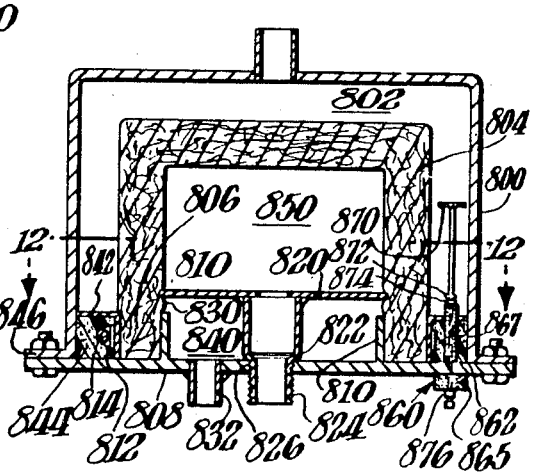
Fig. 11.
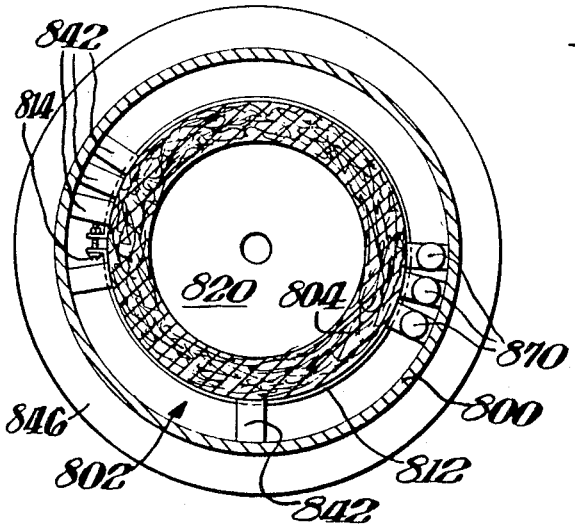
Fig. 12.

Fig. 17.
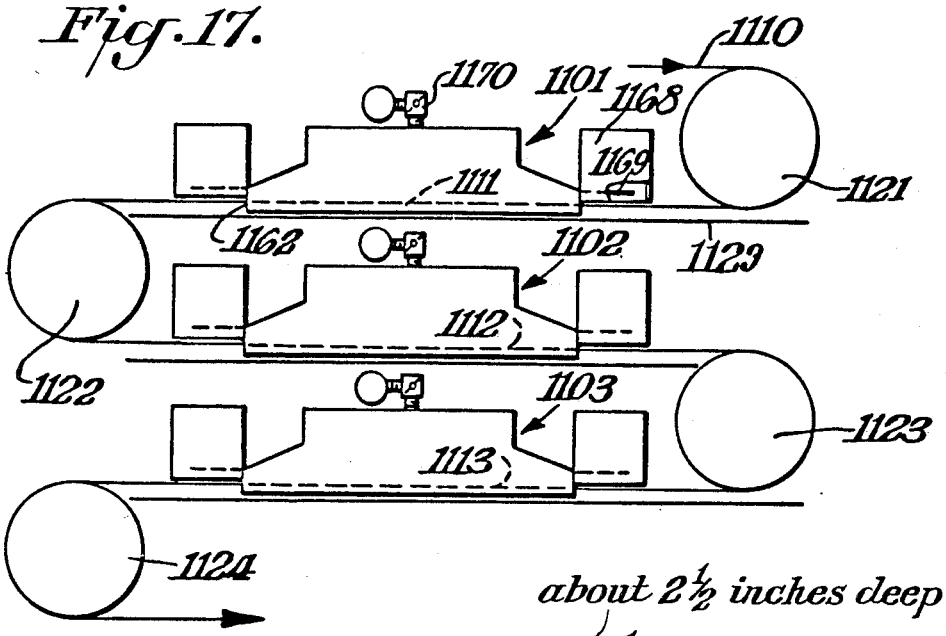
Fig. 21.
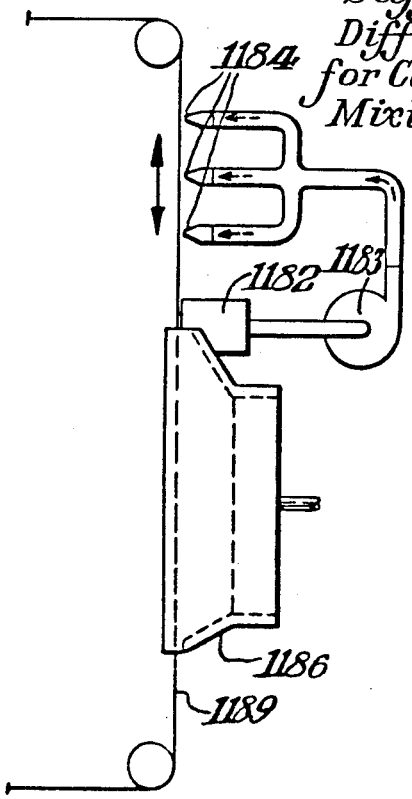
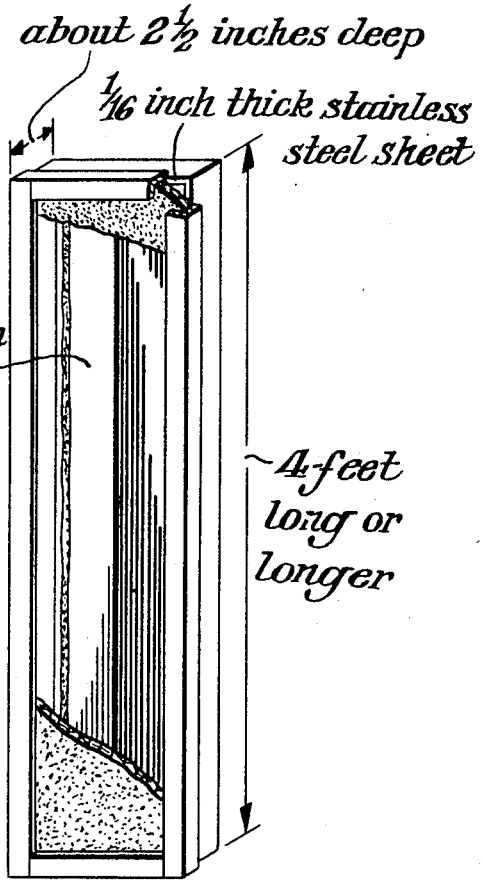
Fig. 15.

1840
1859
1891
Exhaust
1814
1851
1852
Ambient
1853
1854
1857
1858
1844
1843
Combustion Mixture
1855
1857
1846
1882
1847
1848
1850
1849
1845
1856
1838
1839

1904
1906
1900
1916
1931
1912
1918
1922
1932
1910
1902
1900

1888
1838
1890
1892
1894
1838
1896

INFRA-RED IRRADIATION

This application is a continuation-in-part of applications Ser. No. 592,793 filed Mar. 23, 1984, Ser. No. 567,270 filed Dec. 30, 1983, and subsequently abandoned, Ser. No. 509,161 filed June 29, 1983, now U.S. Pat. No. 4,500,283, Ser. No. 435,412 filed Oct. 20, 1982, and subsequently abandoned, and Ser. No. 292,167 filed Aug. 12, 1981, now U.S. Pat. No. 4,474,552.

Those five earlier applications are linked by direct or chained co-pendency to the following still earlier applications:

Ser. No. 312,730 filed Oct. 19, 1981 (U.S. Pat. No. 4,443,185 granted Apr. 17, 1984), Ser. No. 279,081 filed June 30, 1981 (U.S. Pat. No. 4,416,618 granted Nov. 22, 1983), Ser. No. 186,491 filed Sept. 12, 1980 (U.S. Pat. No. 4,378,207 granted Mar. 29, 1983), Ser. No. 238,418 filed Feb. 26, 1981 (U.S. Pat. No. 4,447,205 granted May 8, 1984), Ser. No. 178,121 filed Aug. 14, 1980 (U.S. Pat. No. 4,373,904 granted Feb. 15, 1983), Ser. No. 94,901 filed Nov. 16, 1979 (U.S. Pat. No. 4,272,238 granted June 9, 1981), Ser. No. 20,079 filed Mar. 13, 1979 (U.S. Pat. No. 4,290,746 granted Sept. 22, 1981), Ser. No. 952,332 filed Oct. 18, 1978 (U.S. Pat. No. 4,326,843 granted Apr. 27, 1982), and Ser. No. 775,838 filed Mar. 9, 1977 (U.S. Pat. No. 4,272,237 granted June 9, 1981).

The present invention relates to gas-fired radiant heaters as in U.S. Pat. Nos. 4,272,237 and 4,290,746, and to equipment with which they are used. Such burners have a panel of interfelted ceramic fibers, a gaseous combustion mixture being continually passed through the panel and burned at the panel face from which it emerges. The combustion takes the form of a flame that extends over the entire area of the face from which the combustion mixture emerges, the flame length being very small so that the surface fibers at the flame are heated to red heat or hotter and form an essentially continuous wall of heat that makes a very effective radiator of highly concentrated heat. By increasing or decreasing the rate of flow and/or changing the composition of the combustion mixture, the temperature of the heated fibers can be controlled. The contents of U.S. Pat. No. 4,272,237 are hereby incorporated herein as though fully set forth.

Among the objects of the present invention is the provision of novel heater structures that are simple to construct and provide improved operation.

Further objects of the present invention include the provision of novel processes for irradiating with infrared radiation.

The foregoing as well as additional objects of the present invention will be more fully understood from the following description of several of its exemplifications, reference being made to the accompanying drawings in which:

FIG. 9 is a broken-away plan view of a portion of a heater showing a detail feature suitable for use according to the present invention;

FIG. 10 is a sectional view of the construction of FIG. 9, taken along line 10—10;

FIG. 11 is a sectional view of a novel heat exchanger incorporating a ceramic fiber heater and illustrative of the present invention;

FIG. 12 is a section view of the burner of FIG. 11 taken along line 12—12;

FIG. 13 illustrates an enclosed burner construction of the present invention;

FIG. 15 is an isometric view of a burner showing a detail of the present invention;

Figure 1:
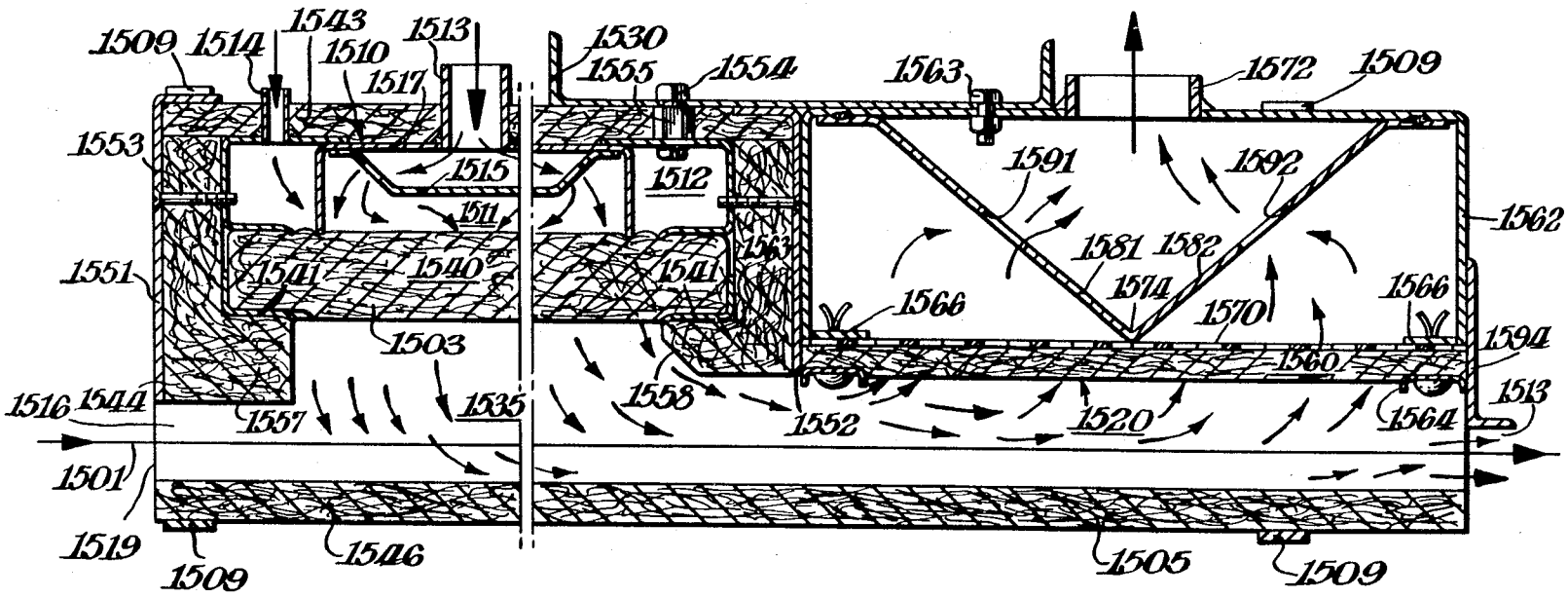
FIG. 1 is a sectional view of a heater construction pursuant to one aspect of the present invention.
Figure 16:
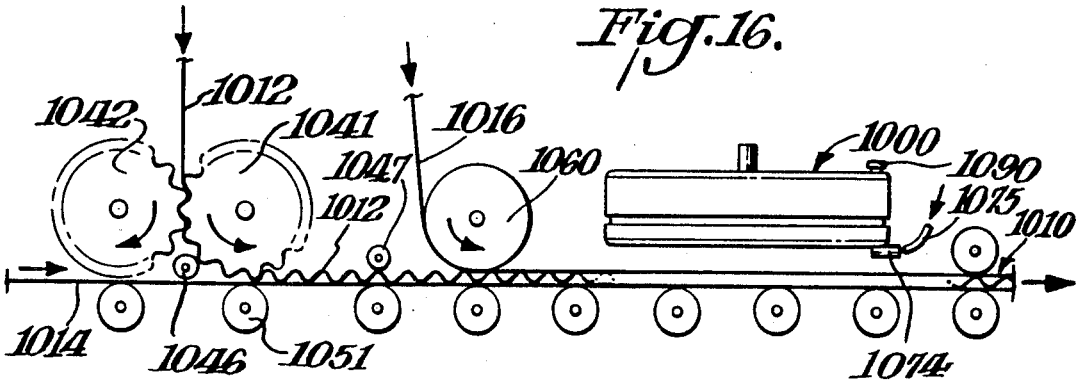
Figure 18:
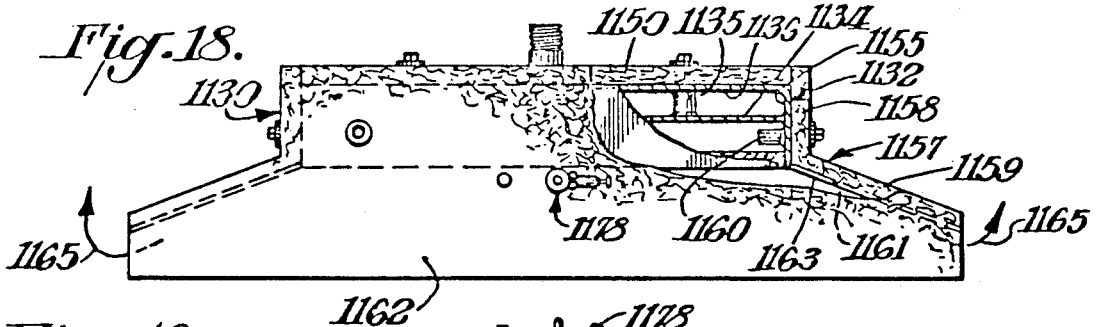
Figure 19:
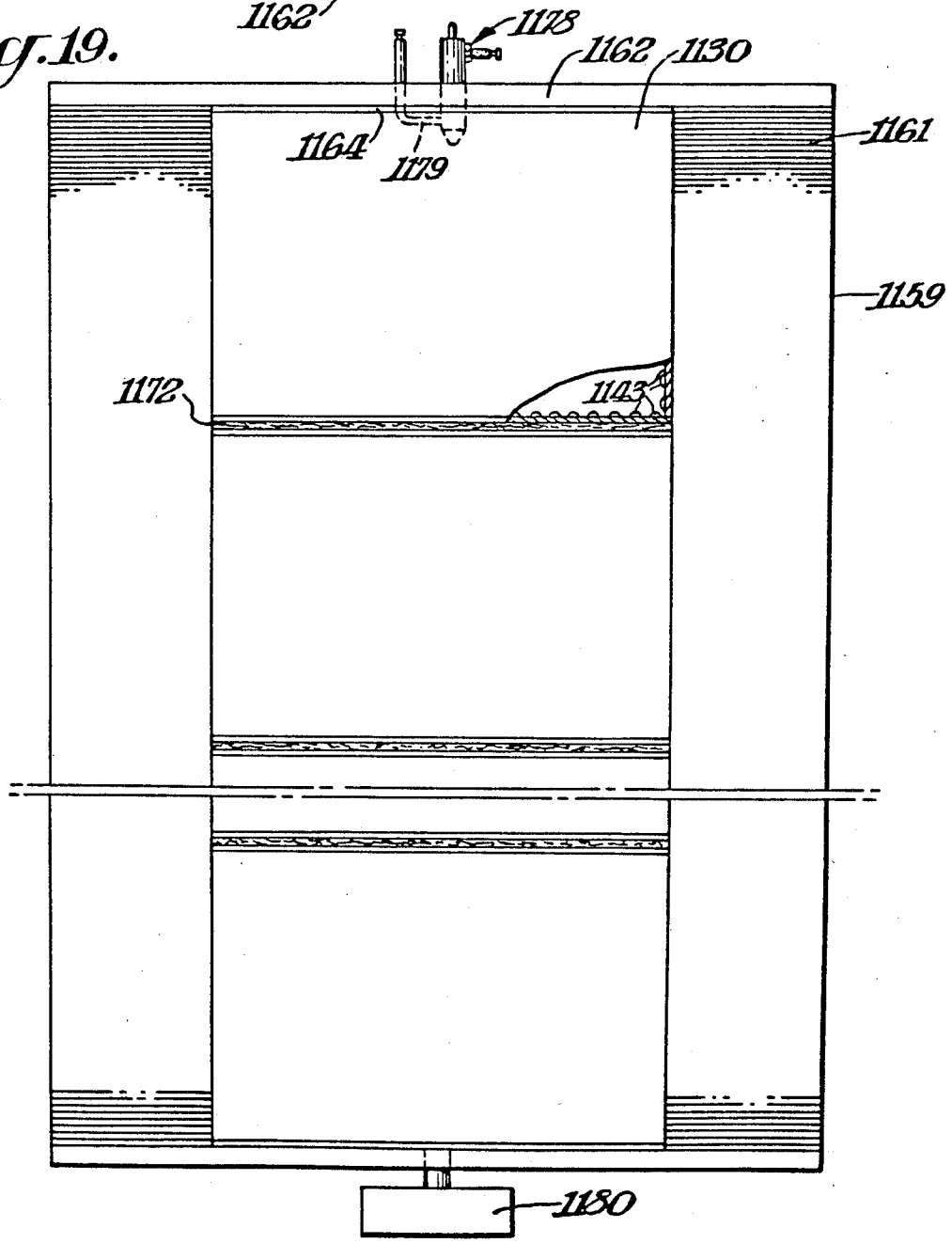
Figure 22:
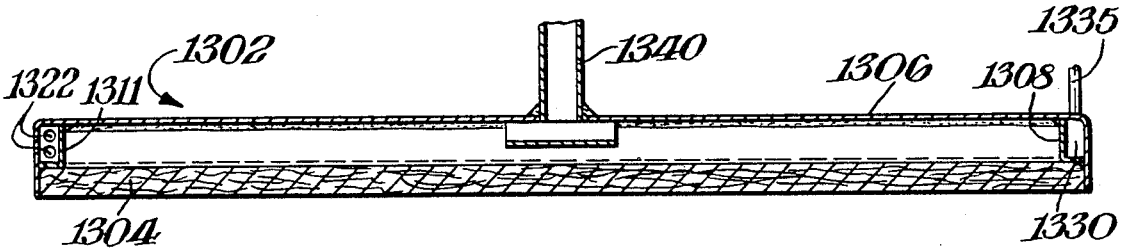
Figure 23:
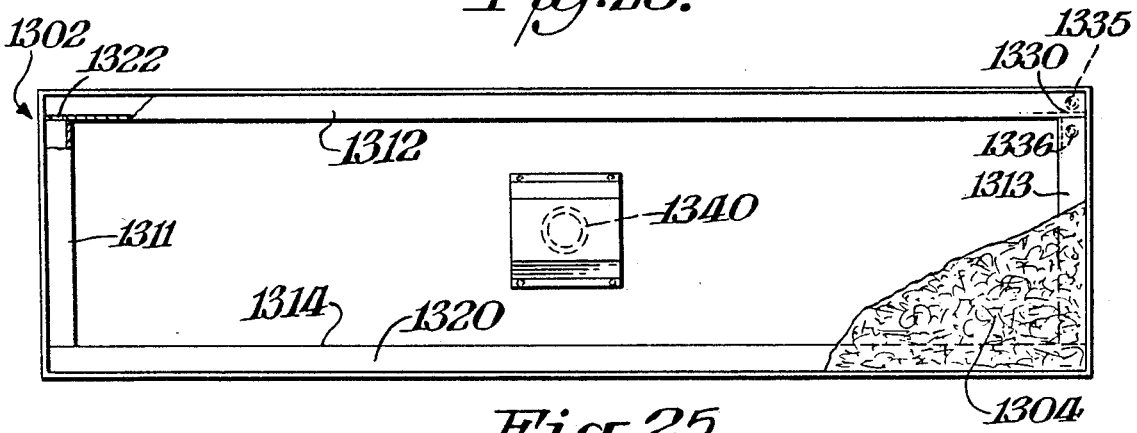
Figure 25:
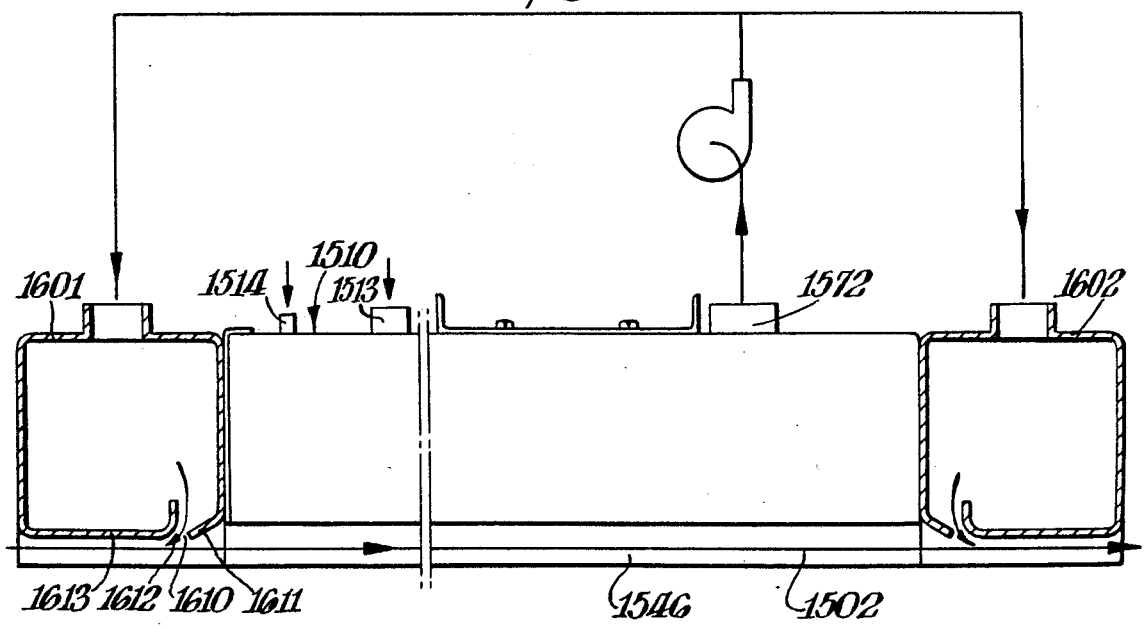
Figure 25A:
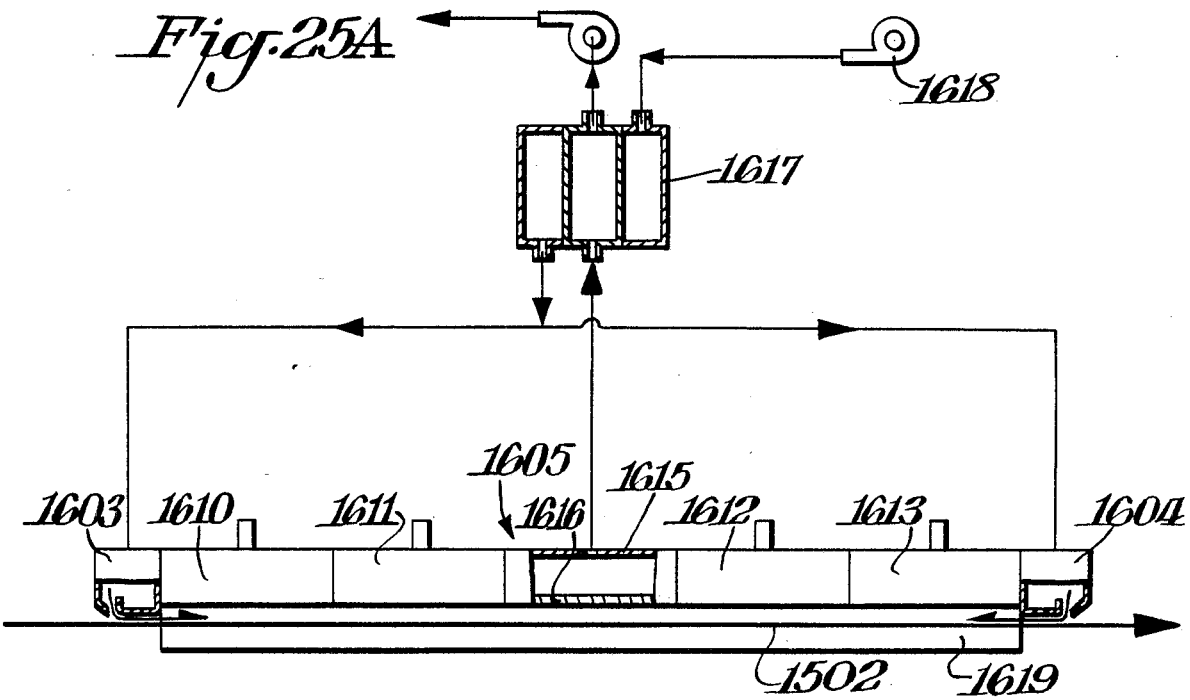

FIG. 16 schematically illustrates the making of corrugated board pursuant to the present invention;

FIG. 17 is a chematic side view of further embodiments of the present invention;

FIG. 18 is a detail side view with parts broken away, of a burner in the construction of FIG. 17;

FIG. 19 is a view of the burner construction of FIG. 18, taken from the face of the burner;

FIGS. 20, 21, 24 and 30 are schematic side views of additional heating apparatus typical of the present invention;

FIGS. 22 and 23 are sectional and face views, respectively of a liquid-cooled burner of the present invention;

FIG. 25 is a partly sectional view of a variation of the FIG. 1 apparatus, modified for use in heat-treating webs;

FIG. 25A is a somewhat diagrammatic view of a further modified heating apparatus of the present invention.

Figure 26:
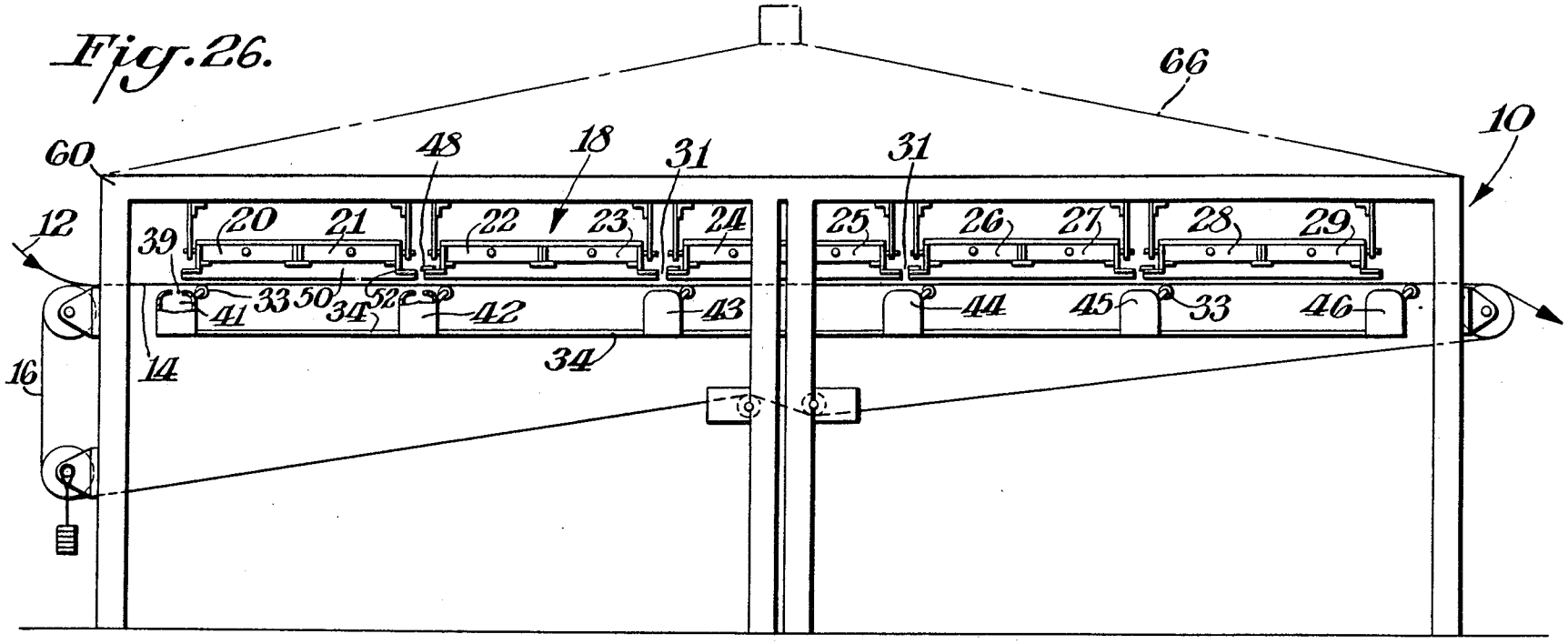
Figure 27:
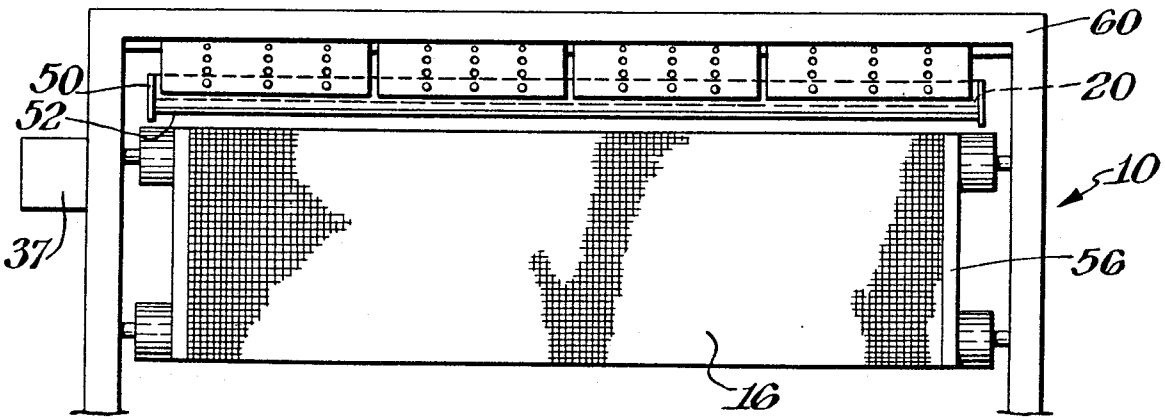
Figure 28:
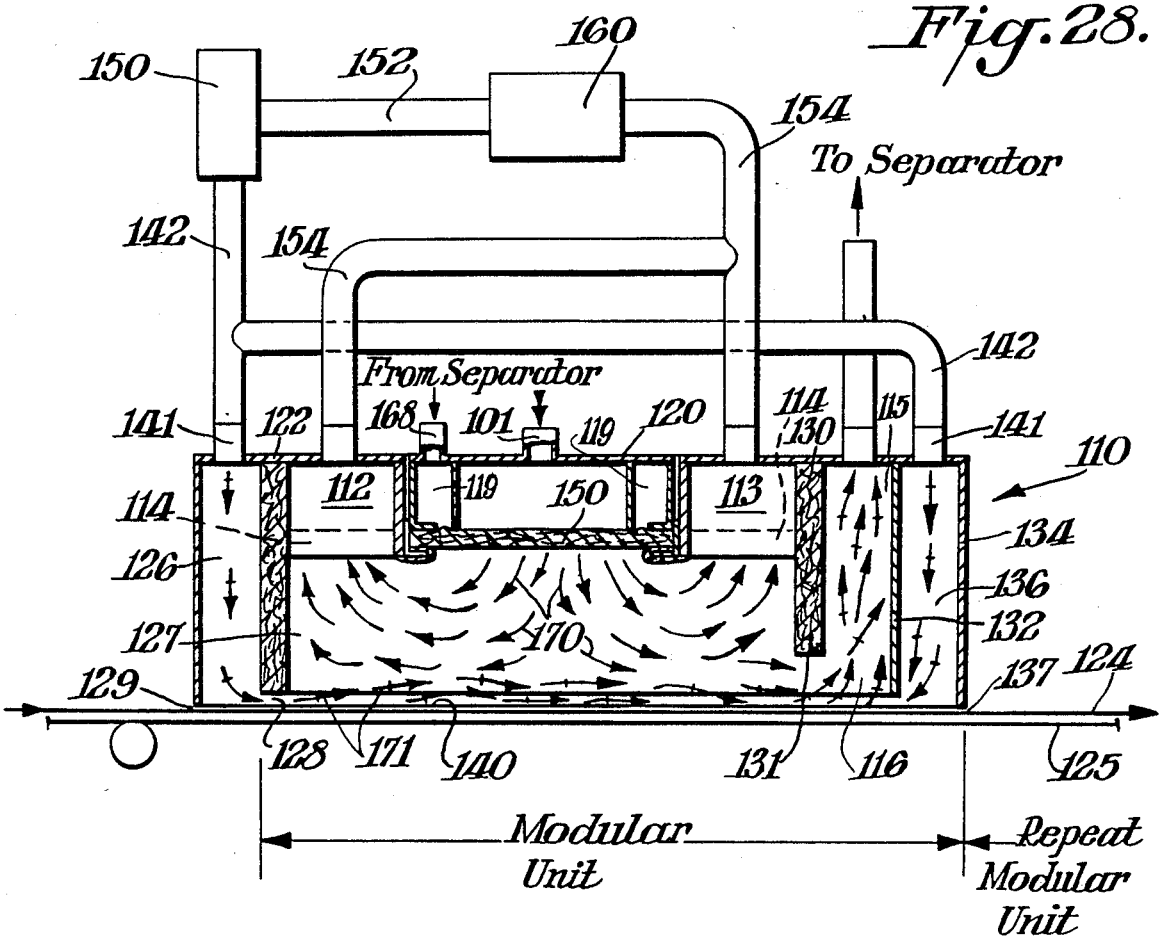
Figure 29:
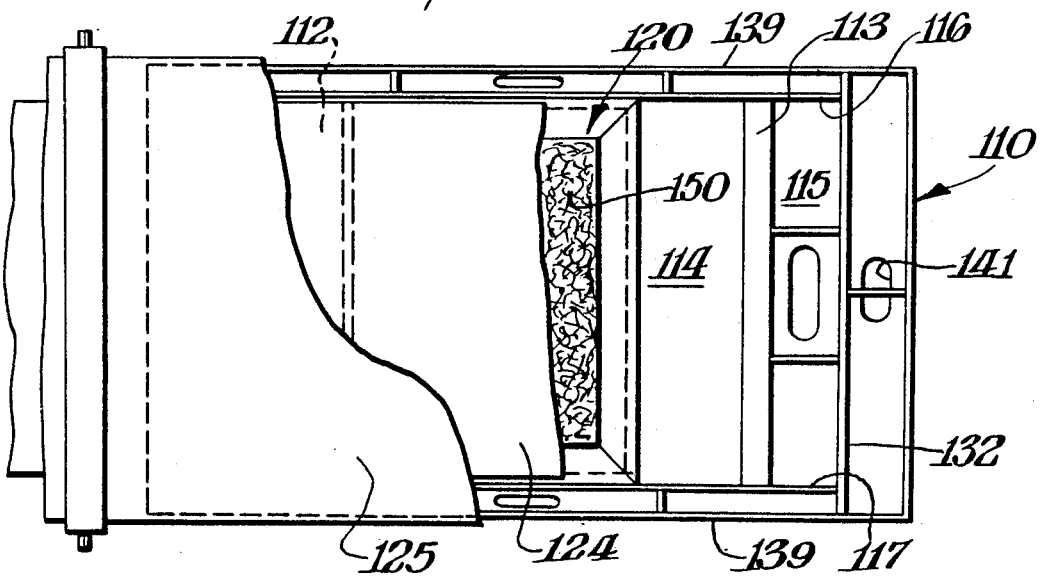

FIG. 26 is a side view of yet another web-heating apparatus incorporating the present invention;

FIG. 27 is a view of the apparatus of FIG. 26 taken from its inlet end;

FIG. 28 is a sectional view of a heat-treating apparatus for driving off from a web, vapors that require special handling;

FIG. 29 is a view of the apparatus of FIG. 28, taken from below;

FIG. **29*a*** is a front view of an apparatus for irradiating the edges of sheets in accordance with the present invention.

Figure 31:
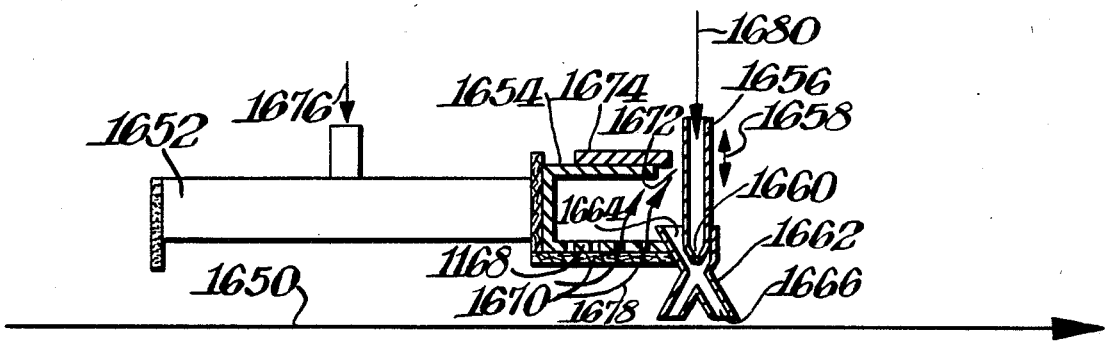
Figure 32:
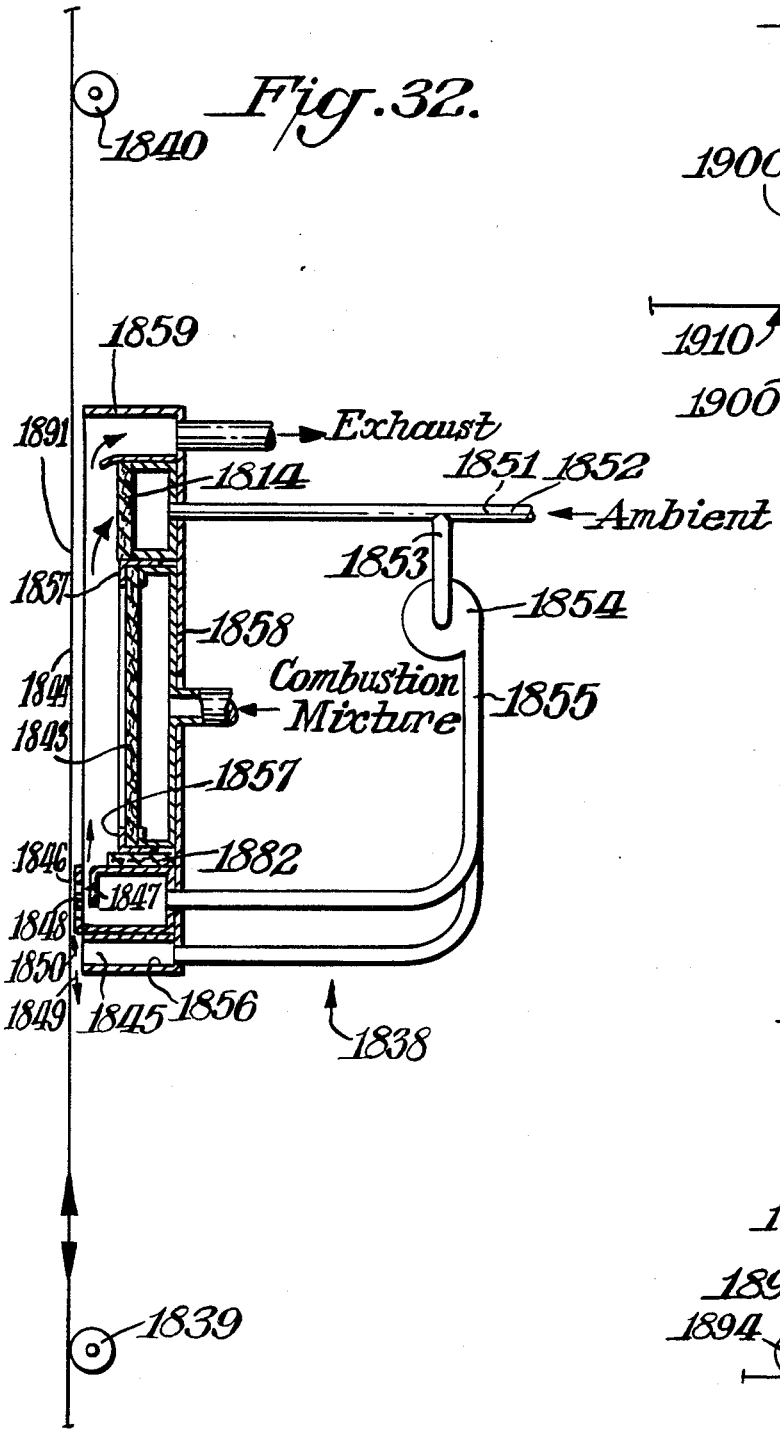
Figure 33:
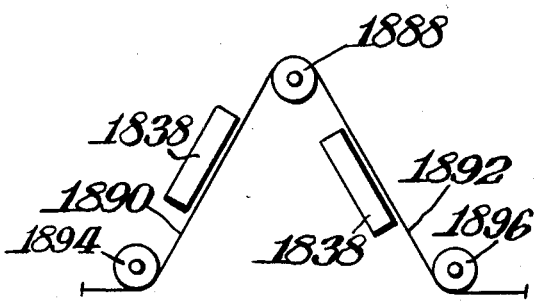
Figure 30:
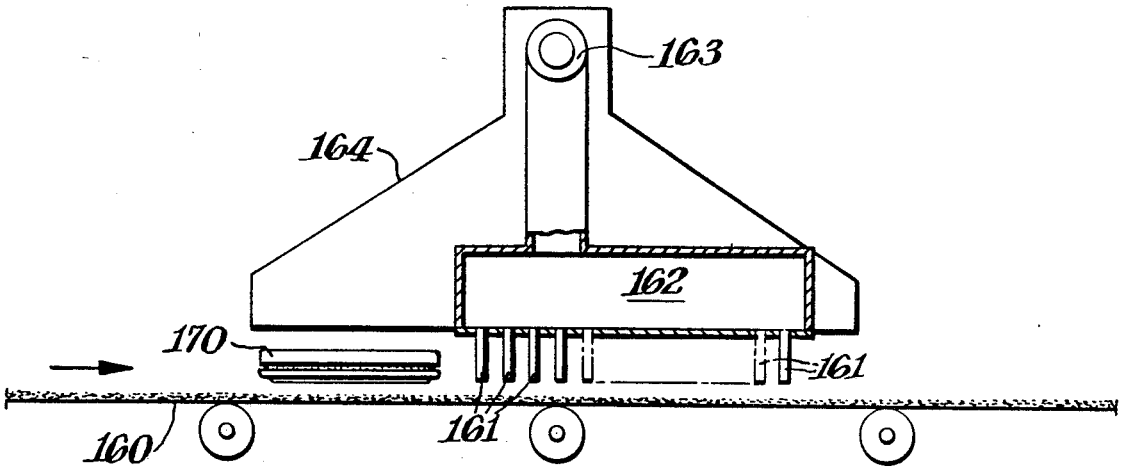
Figure 35:
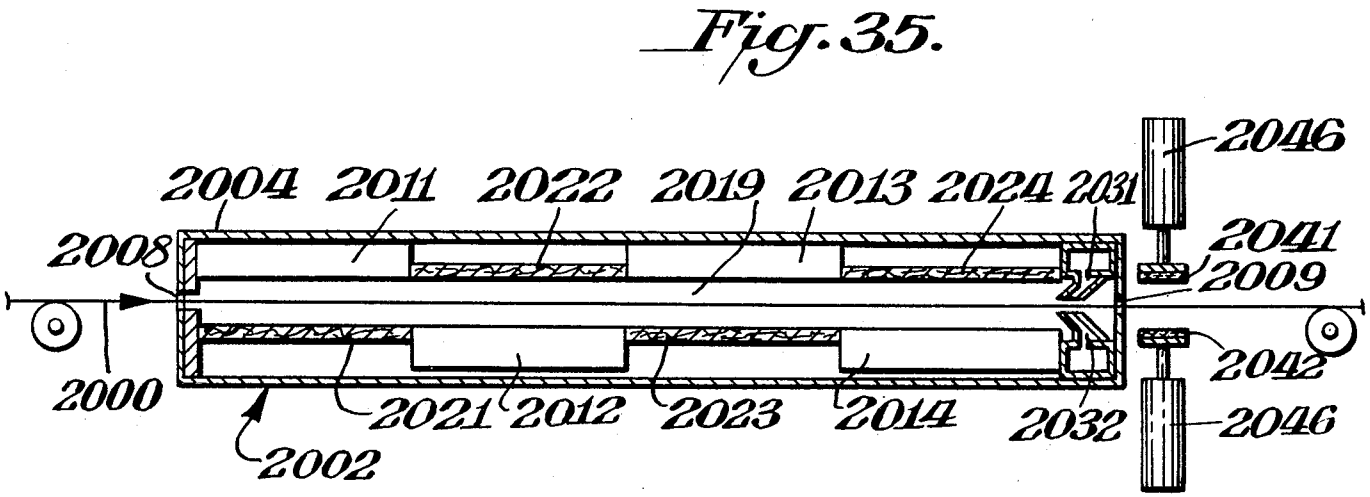
Figure 34:
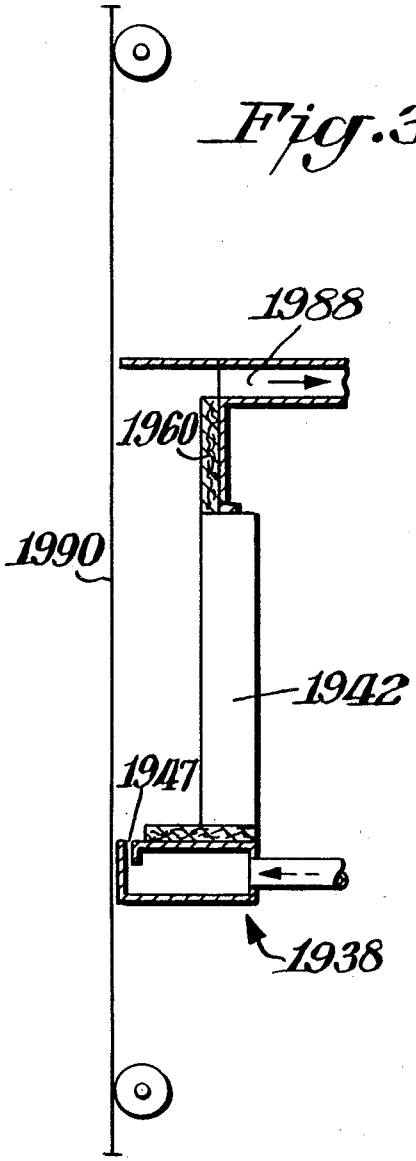

FIG. 30 is a partly sectional side view of an alternative heat-treating apparatus according to the present invention;

FIG. 31 is a partially detailed side view of a modified embodiment of the apparatus of FIG. 26;

FIG. 32 is a somewhat diagrammatic sectional view of a further modified embodiment; and FIGS. 33, 34 and 35 are very schematic side views of variations of the embodiment of FIG. 32.

According to the present invention a gas-fired radiant heater having a supported porous refractory panel through which a gaseous combustion mixture is passed and on the face of which the mixture is burned as it emerges, is operated with improved results by keeping the panel supports from overheating and from bowing when in operation, and by using the heat in the hot combusted gases to further assist with the heating of the desired material.

FIG. 1 shows a particularly effective heating arrangement for heat treatment of a moving web such as in textile drying and curing or paper processing or curing coatings on webs or wires. The illustrated construction is a modification of the construction of FIG. 22 in parent application Ser. No. 186,491 with parts similarly numbered, and can be constructed in a similar manner. The description in that application is hereby incorporated herein as though fully set forth.

A key modification in FIG. 1 is the use of the apparatus for curing coatings on wires. A horizontal row of freshly coated parallel wire strands 1501 is passed below the incandescent face 1503 of the burner 1510 as well as below the face 1520 of re-radiator panel 1560. Also a supplemental re-radiating panel 1505 is mounted below the wires 1501, by securing it between the skirts 1536 of depending side panels.

Panels 1560 and 1505, as well as skirt faces 1516 can be of the same ceramic fiber re-radiator construction forming an almost complete enclosure around the wires 1501. Such an arrangement provides highly efficient wire heating inasmuch as the radiant energy created at burner face 1503 reverberates throughout the enclosure with essentially the only escape at the relatively shallow apertures 1511, 1513 through which the wires enter and leave. Some of that energy is also absorbed by the wires and their coatings, so that making the apertures 1511, 1513 smaller increases the efficiency of the heat transfer to the wires and their coatings, and decreases the rate heat is required to be generated at burner face 1503.

Reducing the surface area of the walls bounding the reverberation compartment also decreases the loss of heat through those walls and likewise decreases the rate of required heat generation.

According to the present invention the reverberation compartment preferably has its walls not more than about 1 inch from the wires, and extends longitudinally of the wires a distance no more than about twice the longitudinal span of burner face 1503. With such an arrangement there is no need to make the apertures 1511, 1513 any smaller than the cross-section of the reverberation compartment, although for best efficiency those apertures can have half that cross-section, or less. Panel 1505 can be made readily removable if it is desired to simplify the threading of the wires through the reverberation compartment. To this end, panel 1505 can be held in place by metal clips 1509 snapped over the top of the apparatus.

As described in Ser. No. 186,491, the hot combustion gases emitted from burner face 1503 are carried over through re-radiator panel 1560, which is porous, and drawn off at outlet 1572. This action helps heat up surface 1520 and thus increase its re-radiation effectiveness.

The construction of FIG. 1 can be operated upside down so that the burner face 1503 faces upwardly, and in such an arrangement the sucking of the hot combustion gases through panel 1560, or through any other panel is ordinarily not needed. Those hot gases can be merely permitted to flow out the ends of the reverberation compartment. However the sucking action does help increase the temperature of the face of the panel through which the sucking takes place. Moreover when the wires have coatings that give off noxious gases such as vaporized coating solvent, the sucking action can be used to collect those gases and in this way better control their disposal.

Additionally many gases so evolved are combustible and can be made to burn on the surface 1520 through which they are sucked, to thus further increase the heating and curing effectiveness of the apparatus of the present invention, and at the same time reduce its environmental impact. A coating of platinum black particles can be applied to surface 1520 as by spraying it with a solution of chlorplatinic acid and then heating the sprayed surface to a temperature that decomposes the chlorplatinic acid. Catalyst weights of as much as one to two grams per square foot of gross surface (as measured with a ruler) can be used. Other platinum family metals and oxidation catalysts can be substituted for the platinum. Cerium oxide and the oxides of other rare earth metals are examples of good oxidation catalysts.

The catalytic combustion feature can be used without the reverberating compartment, as for example when heat treating webs of coated carpeting or other gas-generating materials that are essentially opaque to the radiation with which they are treated.

It is noted that the catalytic combustion of vapors generally calls for the presence of significant quantities of oxygen in the vapor-carrying gases. Burner 1510 is of the air-seal type through which a curtain of air is discharged from plenum 1512, and the rate of such discharge can be controlled to assure the presence of sufficient air in the gas stream sucked through panel 1560. Some air can be introduced from the surrounding atmosphere, particularly where no reverberation compartment is used, so that the air-seal air may not be needed to supply all the oxygen for the catalytic combustion.

Figure 3:
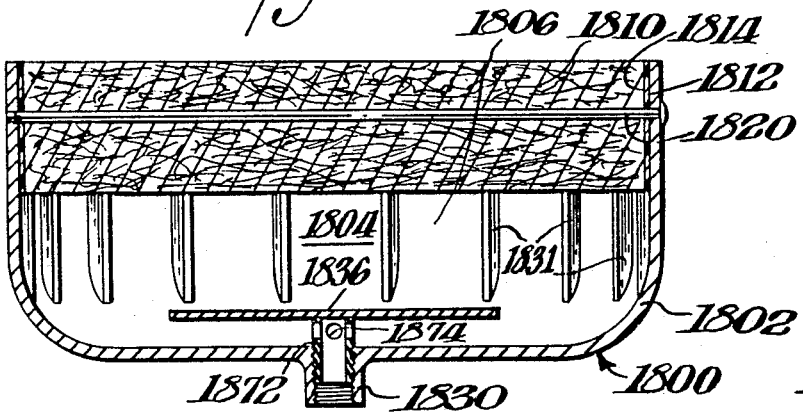
FIGS. 2 and 3 are sectional views of modified constructions exemplifying the present invention.
Figure 4:
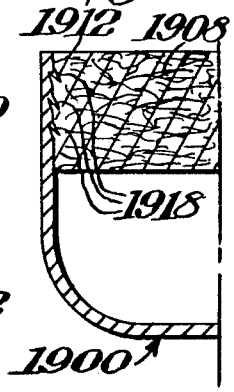
FIG. 4 is a broken-away view similar to FIG. 3 of a further modified construction.
Figure 2:
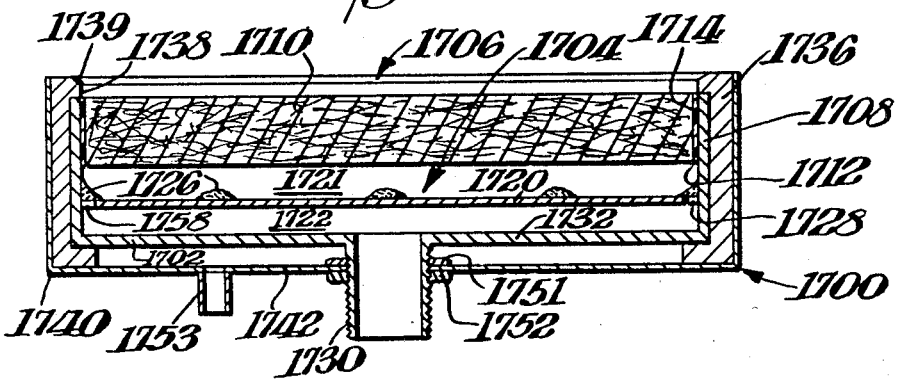

Whether or not air is needed for addition to the hot combustion gases, burner 1510 can be replaced by one that is not of the air-seal type. The hereinafter described constructions of FIGS. 2, 3, and 4, are examples of this type, when the outermost cooling jacket of FIG. 3 is omitted. Additional air can be entrained in the gaseous mixture burned on the surface of 1540 in the form of excess air. As much as 50% excess air could be entrained without seriously affecting total efficiency.

The reverberating compartment feature of the present invention is particularly suited for irradiating substrates too open or transparent to effectively absorb an impinging irradiating beam having a substantial cross-sectional area. Woven screening or highly transparent plastic webs are further examples of such substrates.

FIG. 2 shows a burner 1700 that operates well without the so-called air-seal 1512 of FIG. 1. Burner 1700 has a body 1702 of relatively thick metal and shaped, as by welding together rectangular plates, to provide the combustion mixture plenum 1704. The mouth 1706 of the plenum body receives a ceramic fiber matrix 1710 which is shown with its edges adhered to the inside surface 1712 of the mouth by a cement 1714 that withstands temperatures at least as high as 400° F., preferably at least as high as 450° F. or 500° F.

A silicone cement is very effective for this purpose.

The mixture plenum is relatively shallow, only about an inch deep, and it is separated into upper and lower chambers by a partition 1720 extending across it. The partition is slightly smaller in length and width, than the plenum, and is tack-welded at spaced locations 1726 to the plenum walls so as to leave a narrow passageway 1728 around its periphery. A threaded connector 1730 is welded into an opening in the back wall 1732 of the burner to receive the combustion mixture, and another connector can be similarly provided for pressure measurement, if desired.

Burner 1700 is illustrated as also having its side walls 1708 surrounded by insulation. Preformed blocks 1736 of insulation that can be made of the same material as the matrix 1710, are shaped to fit against those side walls as well as over the top and under the bottom of each wall. Each block can run the full length of the wall it fits against, and the blocks can be mitered together at the burner corners. The blocks can be cemented in place, or strapped around the burner with baling straps or the like, or they can be held by an enveloping frame 1740. Such a frame need only be a very thin gauge metal sheet notched out at the corners and folded into the box shape shown. The frame can be cemented to the insulation blocks, or a baling strap can be clamped about the frame, or the frame can have its corners welded or crimped together to make a self-supporting structure that holds the insulation blocks in place and protects them against physical damage.

The frame can be secured as shown in FIG. 2 by providing its floor 1742 with an opening that fits snugly around connector 1730 and clamping it to that connector, between two nuts 1751, 1752 threaded to the exterior of the connector. An additional connector 1753 can also be fitted in the frame floor to deliver a cooling gas to the interior of the frame so as to cause the gas to pass through the insulation blocks and escape at the mouth of the frame to thus reduce the absorption of heat by the burner walls 1708 from the hot combustion gases.

As also shown in FIG. 2, the insulation blocks can have a nose 1738 that covers most or all of the upper edge of a burner wall 1708, to further impede the flow of heat to that wall.

The outermost projection of the insulation blocks 1736 can also be beveled as shown at 1739. This reduces the likelihood of physical damage at that location and also makes the projecting insulation face better reflect away incoming infra-red radiation that would otherwise reach the mixture face and tend to overheat it.

The elaborate protection features of FIG. 2 can be dispensed with. Thus a burner having a body made of aluminum about ⅛ inch thick operates very effectively without the help of any external insulation or air flow, and even if the burner is not equipped with the plenum partition 1720. Although the matrix 1710 is installed in such a burner as a slip fit so that it is only held in place by silicone cement or resin applied as a very thin film to the matrix edges and to the burner wall which it engages, the matrix remains securely held in place by the silicone through many hours of face-up operation with the outer matrix surface at 1600° F.

Removal of the matrix after such operation shows the silicone to be essentially undamaged, even at the lip where the silicone is in contact with incandescent matrix fibers. It appears that a metal wall ⅛ inch thick having the thermal conductivity of aluminum withdraws heat from the silicone layer so rapidly that it keeps the layer from heating up to the temperature at which it begins to be damaged.

Silicone layers about 40 mils thick may begin to be damaged where they are in contact with incandescent fibers, but if there is such damage it is confined to the portion of the layer most remote from the heat-withdrawing side wall and does not significantly impair the operation of the burner or shorten its useful life. Compounding the silicone with particles of finely divided metal such as aluminum or copper makes the silicone more readily conductive to heat and keeps it from being significantly damaged when in a layer as much as 60 mils thick.

Copper has a thermal conductivity substantially higher than that of aluminum and can be used in place of aluminum for the burner body. A copper body will provide the operation described above even when its wall thickness is only about 70 mils. Steel on the other hand has a thermal conductivity poorer than aluminum, and a steel wall thickness of about ¼ inch provides about the same results as a ⅛ inch thick aluminum wall.

In order to better allow for the simple sliding of a matrix in place in the burner of FIG. 2, the walls 1708 of the burner body are preferably joined together at the corners so as to present an essentially zero inside corner radius. Thus the body can be made from a square or rectangular metal sheet whose corners are notched out to leave four flaps projecting from a center panel. These flaps are then readily folded up to make the walls, and then joined together at their corners. They can for example be welded together with the welding effected at the external portions of the corners without deforming the inside aspect of the corners and without depositing weld metal on those insides.

Alternatively the walls can be joined at their corners by brazing, and even by cementing as with a silicone resin. Although such resins are frequently of rubbery or yieldable nature, the burner body metal is so thick that it provides adequate rigidity to burners whose wall corners are cemented together even when the burner faces are as large as one foot by two feet.

When the plenum partition 1720 is used and welded to the walls, it serves to greatly increase the rigidity of the burner body and make edge cementing practical for still larger sized burners.

A burner with the foregoing corner construction readily receives a matrix that is merely cut with its edges perpendicular and true, and no effort is needed to round off the matrix corners. Such a cut matrix is merely thinly buttered over its edges with the cement, a thin bead of cement is applied along the inside faces of the upper portions of the walls, the matrix is laid flat on a table top, and the burner body turned face down and lowered over the matrix until the burner lips also rest on the table top. The assembly is then permitted to stand an hour or so to allow the cement to cure, after which the burner is ready for use.

The burner without the external insulation and without the plenum partition can also be operated face down or with the plane of its matrix vertical, but the burner body is then subjected to heating by the rising hot combustion gases and becomes hotter than it does when operated face up. For such more rigorous operation, it is preferred that the matrix temperature be not over about 1450° F., or that the operation be discontinuous so that the temperature of no part of the burner walls reaches 500° F.

The application of external insulation to the exterior of the uppermost burner wall when the burner is operated tilted, or to the exterior surfaces of all walls when the burner is operated face down, keeps the burner body cooler. Such insulation need only be about ¼ inch thick but should be thicker when it is to be in the form of a fitted block as shown in FIG. 1. It is perfectly adequate in most cases however to merely wrap a strip of insulation blanket around all four outer walls of the burner, and strap the wrapped strip in place.

The use of the plenum partition 1720 also helps cool the side walls inasmuch as the partition causes all of the cold combustion mixture to sweep past the inside surfaces of those walls and thus cool them by an appreciable amount. A burner so constructed operates continuously face down without external insulation but with the maximum matrix temperature about 1500° F.

The cooling effect of the partition is increased by welding a greater proportion of its edge to the walls so that the partition helps conduct heat away from the walls. Also diminishing the depth of the plenum 1704 between the matrix and the burner back 1732 shortens the path by which heat is conducted from lips of the side walls back to the burner back and to the combustion mixture supply pipe, and this also helps cool the walls better. Thus the plenum depth can be made as small as ⅜ inch, the corners of the plenum can be beveled, and/or the matrix itself can be made relatively thin, 1 inch or ⅞ inch, to improve the rate of heat flow away from the burner lips.

With a burner floor about ⅛ inch thick, the connector 1730 need not be welded in place, but can be threadedly engaged in that floor. For this purpose the floor has a connector opening punched out, the edge of that opening threaded, and the connector then threaded into it. If desired the punching out of the opening can be arranged to also draw some of the metal out around the margin of the opening and thus leave the metal edge of the cut longer than the original floor thickness. This provides a longer distance for the thread to extend over at the cut, and strengthens the threaded connection to connector 1730.

The matrix 1710 is not required to be a slip fit in the burner mouth, but can be a tight fit that calls for forcing the matrix into place with its edges squeezed against the burner walls. Such a forced insertion generally squeezes out some of the resin that may be buttered over the matrix edges, so that it is then desirable to use a little extra resin for this arrangement or to use a matrix that has its edges pre-treated with resin that is allowed to cure or partially cure, and then butter the thus cured edges with less resin.

Alternatively the matrix can be loosely cemented to the side walls while those walls are not fully bent over to their final position, and the walls subsequently bent to the final position to thus squeeze against the matrix edges. Such a final bending can bring the walls a few degrees past the perpendicular so that they taper toward each other and thus lock the matrix in against being blown out by the pressure in the plenum.

The inner faces of the side walls can also be provided with cooling fins, particularly when a plenum partition is used, to further improve the transfer of heat from the side walls to the combustion mixture passing through the plenum. Such fins are readily provided by casting the burner body, and such a construction is illustrated in the burner 1800 of FIG. 3.

Burner 1800 has a matrix 1810 cemented in place at 1814 against the side walls 1812 of a burner body 1802, and seated against the upper ends of a set of finds 1831 cast in place when the body is cast.

To make sure the matrix is held in place, one or more securing rods 1820 is fitted through the matrix and received in sockets drilled laterally into the wall of mouth 1806. Where the sockets penetrate through that wall a little silicone cement can be painted over the outer face of the sockets to help guard against leakage of combustion mixture. Such securing rods are particularly helpful with burner bodies in which the side walls flare outwardly a little and are thus less expensive to cast.

Burner 1800 is also fitted with a deflector or baffle 1836 that directs the incoming combustion mixture toward the fins. Also the corners of the body 1802 are rounded so that the flow of combustion mixture sweeps along the fins in a more streamlined manner. The deflector 1836 is shown as fitted with a mounting tube 1872 that is threaded and threadedly engages in a combustion mixture inlet 1830 which is formed in the burner floor during the casting. The engagement can be locked in by a bit of cement applied so that it at least partially works its way between engaging portions of the thread and then hardens there. Tube 1872 can also have perforations 1874 to permit the combustion mixture to pass into the plenum 1804.

The thermal sheathing of FIG. 2 can be used with the construction of FIG. 3, or in place of the thermal sheathing in the construction of U.S. Pat. No. 4,272,237, in which event the FIG. 2 sheathing can cover the entire upper face of the hold-down frame 342, or can leave exposed a narrow width of frame edge bordering the exposed matrix face.

The cementing of the matrix edges to the side walls not only holds the matrix in place but also seals the joint between matrix and side wall, against passage of combustion mixture. Such sealing is not essential however, and the incandescent fibers can directly engage the mouth and the construction as indicated by burner 1900 in FIG. 4. The matrix 1908 can be squeezed in place so that its edges are securely engaged by teeth 1918 staked out of the side walls 1812 and the squeezed matrix is thus locked in place. Such engagement will hold a matrix in place in a plenum 6 inches wide and 12 inches long, against a combustion mixture pressure of as much as 4 inches of water column. For greater pressures or larger dimensions, a little adhesive can be applied between the matrix edge and the plenum mouth and/or screws can be threaded into the side walls from the outside of the burner with the screw shanks penetrating an inch or more into the matrix. No thermal dissipation fins nor partitioning are needed in the construction of FIG. 4 when there is no cement to protect at the matrix edge, although they can be used to keep the metal temperature low. Similarly the wall thickness at the burner mouth can be thinner than for the constructions in which the matrix is cemented in place, and here also the extra thickness will help hold the metal temperature down.

Figure 5:
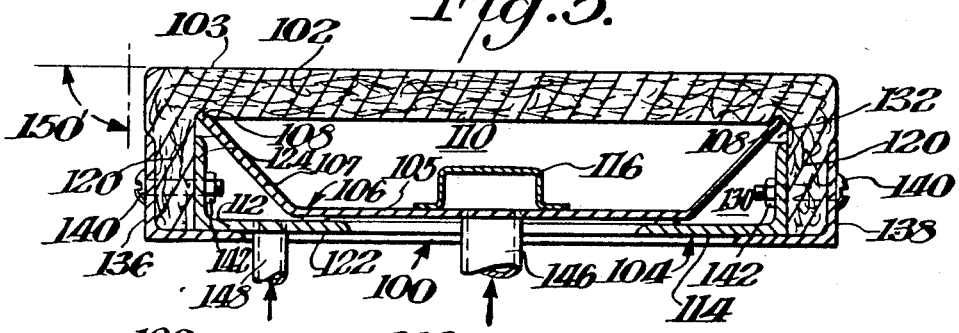
FIG. 5 is a sectional view of a gas-fired radiant heater according to another aspect of the present invention.

FIG. 5 illustrates a heater 100 with an air seal. Heater 100 has a cup-shaped matrix panel 102 of interfelted refractory fibers as described in U.S. Pat. No. 4,272,237, clamped by its edges around a support assembly 104 made of stainless steel or other metal members shaped from relatively thin stock, about 1/16 inch thick. A central dish 106 has a floor 105 and inclined walls 107 with raised edges 108 which the panel 102 is pressed to define a combustion mixture plenum 110. Outer face 103 of panel 102 is of rectangular shape, and so is plenum 110.

Secured to the outer margin of the floor 105 of dish 106 is a series of angles two of which are shown at 112, 114, defining a rectangular frame against which the edges 120 of panel 102 are fitted. These angles are illustrated as having horizontal webs 122 welded or brazed to the floor of dish 106, and vertical webs 124 that approach but do not quite reach the dish edges 108. The frame angles define with dish walls 107 an outer plenum 130 that encircles combustion mixture plenum 110 and has a discharge slot 132 that is engaged by the margin of panel 102. The frame members are mitered or otherwise interfitted at the corners of the frame to minimize, or completely seal the outer plenum against leakage in those locations. Supply nipples 146, 148 are fitted in openings in the floor 105 and one or more of the frame angles 112, to deliver, respectively, combustion mixture and non-combustible gas. Baffles such as the U-shaped deflector 116 can also be provided to help more uniformly distribute the incoming gases. Inasmuch as air is generally the non-combustible gas that flows through plenum 130, a little leakage from that plenum doesn't do any particular harm other than consume a little excess air.

A baffle is not needed where the panel 102 is sufficiently resistent to gas flow as to permit the pressure of the combustion mixture in plenum 110 to be maintained at at least as high as 3 inches of water column. With pressures of 4 inches or more burners can be operated very satisfactorily without baffles, even when a single plenum is 60 inches in length and 12 inches in width and is provided with only one mixture inlet. Where the combustion mixture contains finely divided solids or dust, these particles tend to build up in the matrix directly opposite the combustion mixture inlet when no baffle is used, and this can cause uneven incandescence over the matrix face.

Anchoring of panel 102 in place is shown as effected with the help of a series of four or more clamping angles 136, 138, clamping the panel edges 120 against the frame angles, with the help of screws 140 that penetrate through aligned openings in the angles and are threaded into self-locking nuts 142 mounted in webs 124 as by securing clips or welding. The screws which need be no thicker than about 3/16 inch, are readily pushed through the edges of the panel without seriously damaging the panel, and any damage that might promote gas leakage is more than compensated by drawing up the clamps sufficiently to compress the panel edges. Standard panels have a wall thickness of about 1 to 1⅛ inches and an interfiber spacing such that more than half that thickness is fiber and binder, so that compressing the edges to reduce the overall thickness only about 10% sharply reduces the air space between fibers and greatly limits leakage.

However very effective panels of interfelted fibers can be made by needling a mat of such fibers without the help of binder. Such needled panels can be extremely pliable, as compared to molded binder-containing mats that are stiff like boards, and can have their edges compressed down to as little as about 30% of their uncompressed thickness. Even compressing such edges that are originally about one inch thick down to about ⅜ inch provides an extremely effective back-up for the air seal.

For such panels it is preferred that the edge compression be down to about half the original thickness, or less. If desired however a pliable panel can be stiffened over its edges alone, or over its entirety, as by impregnating it with a water solution of starch or the like. In such stiffened condition, the degree of edge compression can be reduced.

To reduce any effect that the compression may have in breaking panel fibers that are binder-impregnated, the panel edges to be compressed are first dipped in water or other solvent for the binder carried by the fibers. Such wetting makes the edges more readily deformable so that the compressing is easily effected without seriously stressing the clamping structures. To assure uniformity of compression of board-like panels, the screws 140 are no more than about 8 inches apart when the angles have the above-noted wall thickness. Where the heaters are operated in confined spaces so that the clamping angles are subjected to considerable reflected heat, it is helpful to cut slots about six inches apart through the vertical webs of those angles, to allow for thermal expansion and contraction without distortion of the support. Such slots need only be about 20 mils wide, but can be omitted where the clamping angles do not engage each other at the corners of the frame so that expansion is possible at those corners.

A feature of the heater construction of FIG. 5 is that a plurality of such heaters can be juxtaposed to make an effectively continuous radiant heating assembly that covers an extended area. Thus individual heaters are conveniently made with rectangular heater faces about one foot by two feet in size, larger sizes of stiff board-like panels being somewhat awkward to manufacture because the molding and handling is more difficult. However by making the smaller sized panels so that their edges 120 are bent down at least about 90 degrees from the plane of the panel body, considering such edge as a flange bent down from a flat sheet, and locating the edge mountings so they are at least partially inboard of the outer face of that flange and not projecting beyond that face more than about 5 millimeters, they juxtapose in a very desirable manner as illustrated in FIG. 6.

Figure 6:
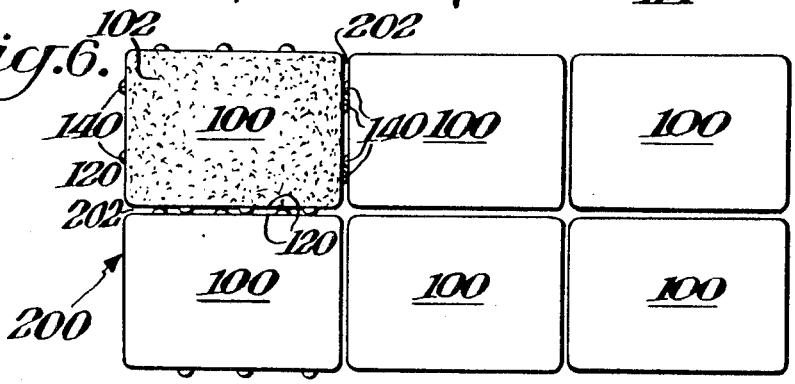
FIG. 6 is a plan view of an assembly of heaters of the type illustrated in FIG. 5.

In FIG. 6 an assembly 200 of individual heaters 100 is made with the adjacent faces of their panel edges 120 about 3 millimeters apart as indicated at 202. The margins of the panel faces 102 can be made so that they have an essentially zero radius of curvature where they bend into the edges 120, but it is sometimes simpler to make them with a radius of about ⅛ inch, and the foregoing 3 millimeter spacing of such rounded corners does not significantly detract from an effectively continuous heater surface junction, particularly where the combustion mixture is arranged to burn over the entire rounded corner. Increasing the spacing from about 3 millimeters to about 5 millimeters does make a significant discontinuity in the radiation uniformity but this can generally be tolerated. Spacings up to about ¼ inch or even up to about ½ inch can also be used.

While the clampig screws 140 are shown as having round heads and thus project out the furthest from the outer faces of the refractory panel edges, such projection is not a problem so long as it is not over the 5 millimeter limit noted above, or the preferred millimeter limit. These screws can be in unsymmetrical locations along each edge, so that the screws on one heater are offset from the screws of an adjacently positioned heater, as also illustrated in FIG. 6. Indeed the round-head screws can be replaced by socket-head screws which project a trifle more but are easier to install during manufacture. Flat-head screws can alternatively be used with the screw openings in the clamping angles countersunk so that the screw heads do not project beyond those angles, if minimum or zero spacing 202 is desired.

Nuts 142 can be omitted and the openings in the vertical walls of support assembly 104 can be threaded, in which event it is desirable to have the threaded aperture slightly undersize so as to make a very tight engagement with the threads of the screws 140.

The burner construction of FIG. 1 can also have panels of the pliable needled type described above. Such a pliable panel behaves very much like a blanket, and can have its edges folded and tucked in place between the side anchorage members. Because of their high pliability, the corners of such panels will squeeze into shape, although it may be helpful to cut away all excess corner material, and to even notch out some of the panel corners to make it easier to clamp these panels into place. It is preferred to confine any notching to portions of the corners covered by the anchorage members so as to reduce the leakage of gas at the notches.

It is not necessary to have the entire margin of each refractory panel 102 flanged over as at 120. Thus each of the panels in FIG. 6 has at least one margin that is not juxtaposed to another panel, and some have two such non-juxtaposed margins. Where only two panels are to be juxtaposed, each can have only one margin provided with a flanged-over edge 120, in which event the remaining three margins can have simple construction as shown in the flat panel exemplifications in the parent applications as well as in FIG. 1.

Very close juxtaposition can also be provided by molding or shaping juxtaposed edges 120 so that they are bent down more than 90 degrees from the horizontal as measured by the angle 150 in FIG. 5. A panel can thus be molded around a suitably shaped molding screen with as many as three of its four sides having flanged edges bent as much as 100 or 110 degrees measured at angle 150, and the thus molded panel can then be slipped sideways off the mold in the direction away from its fourth side. Where only one flanged edge margin is desired, it can be made when molding the panel, or by bending down the edge of a flat-molded panel, after that edge is softened by wetting.

Figure 7:
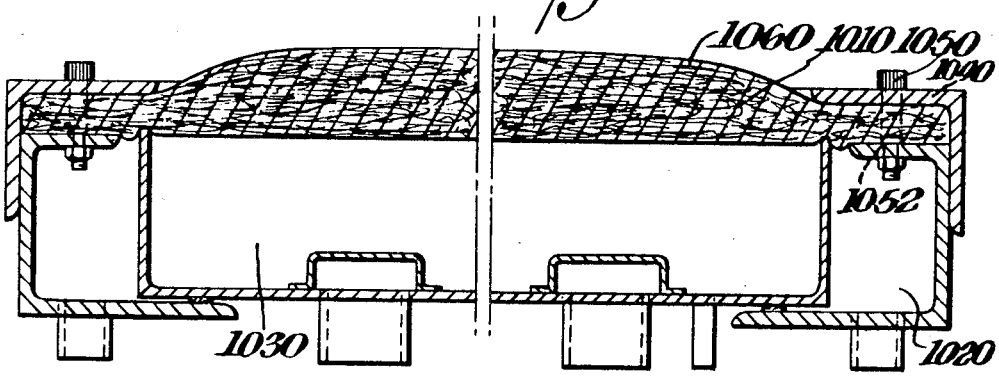
FIG. 7 is a sectional view of a different heater construction pursuant to a further aspect of the present invention.

The needled ceramic fiber panels described above are conveniently manufactured in very long lengths, as long as 25 feet or even longer. Such panels are particularly suited for use with very long radiant heaters, and a construction of this type is shown in FIG. 7.

Here a ceramic fiber panel 1010 about fifteen feet long and about one foot wide, has its edges clamped against the face of an air seal plenum 1020 surrounding a rectangular combustion mixture plenum 1030. Angles 1040 compress and clamp the panel edges, being drawin against the air seal plenum face by screws 1050 that can be fitted with shoulders 1052 against which they can be tightened at relatively high torque with a minimum of attention.

A panel 1010 that is not stiffened with binder or the like, will belly out as shown at 1060, under the influence of the pressure of plenum 1030. This is not particularly harmful, and is in some respects desirable because it reduces the heat radiation from the face of the panel to the clamping angles.

The bellying action can be reduced by pretensioning the panel when it is mounted, or mounting against the outer face of the panel with wire hold-down screen that holds the entire face of the panel in essentially flat condition. The wire of the screen can be made of heat-resistant material like nichrome. Such a hold-down screen can extend from one end of a burner to the opposite end, but need not extend over the entire width of the panel. Thus a matrix panel 7 feet long and one foot wide, and of readily bellied-out construction, will be adequately held with its outer face essentially flat by a long 20-mesh nichrome wire screen 4 inches wide having its ends clamped under or welded to the hold-down frame to position the screen along the central 4-inch width of the panel.

Figure 8:
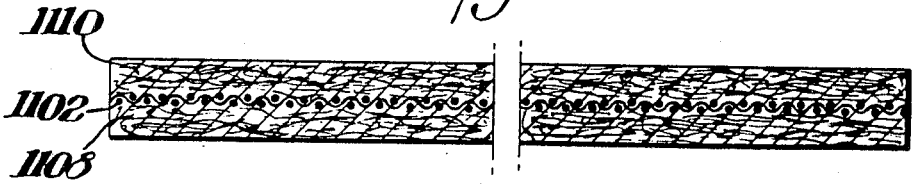
FIG. 8 is a detail view of an alternative heater element for use in the present invention.

Another technique for stiffening a pliable panel is to needle it around a stiffener as shown in FIG. 8, for exmaple. In this construction a wide mesh metal screen 1102 is laid in between two layers 1108, 1110 of ceramic fibers, and a needling operation then performed to interfelt the two fiber layers.

The panel can also be stiffened by encircling it with a metal frame to which its edges are secured as by silicone resin or other high-temperature-resistant adhesive. Such a frame need not have a face flange like that of angles 1040, and can be fitted to a burner body as by screws threadedly engaged between the panel frame and the burner body. Stiff binder-containing panels can also be mounted in this way.

A peripheral stream of non-combusting gas can with such a framed panel, be passed through the panel near its margin, or passed over the frame on the outside of the panel. Either technique keeps the edge adhesive from destruction by overheating.

The radiant heaters of the present invention can be equipped with automatic igniters such as electric spark igniters or pilot lights. FIGS. 9 and 10 show a particularly desirable automatic igniter construction fitted into a heater of the type illustrated in the parent patents. A standard combination 500 of spark rod 501, ground rod 502 and flame-checking rod 503 is mounted so that the rods are generally parallel to and about 1/16 inch above the outer face 505 of the porous refractory panel 340. Below the opposite face of the panel underneath the rod assembly, the box plenum is provided with a partition 507 that isolates a chamber 509 from the remaining space in the box plenum, and the chamber is fitted with its own supply connector 511 to receive a separate combustion mixture.

The spark rod 501 and flame-checking rod 503 are each housed in two identical insulators 550 which go through aligned openings punched in the top flange 520 of the clamping frame 342 and in the flanges 316 and 314 of plenum 304 as shown in FIG. 9. Ground rod 502 is welded or brazed to flange 520. The ends of rods 501 and 503 projecting out through flange 316 are threaded to each accept a connector 542 which holds them in place and provides a ready connection for necessary wiring.

The construction of FIGS. 9 and 10 is operated to start the burners using a safety check. A separate pilot combustion mixture is first started into chamber 509 and at the same time the spark rod is electrically energized to begin sparking. If the flame rod does not sense a flame within a short period of time, such as 10 to 30 seconds, the flow of combustion mixture can be automatically cut off and the starting sequence must then be manually recycled, preferably after the combustion mixture flow is checked as by purging chamber 509. When the starting sequence causes ignition of the separate combustion mixture, the flame-checking rod 503 senses the ignition and opens the valve that feeds the main combustion mixture into plenum 302 which is then ignited by the flame at chamber 509.

By using a small chamber 509 with a low BTU/hour input for the automatic ignition test, the danger of explosion at ignition is minimized. A chamber volume of about 100 cubic centimeters or less is very effective for this purpose. However where the pilot chamber 509 extends along the entire edge of a combustion mixture plenum 302, as indicated in FIGS. 9 and 10, the total volume of the pilot chamber is much larger.

The pilot combustion on the radiating surface of the panel contributes to the overall radiation.

The spacing of the rod assembly from the refractory panel is preferably kept very small so that the rods do not interfere with placing the radiating surface close to the material being irradiated, such as a moving textile web that is being dried. Because the effectiveness of the heater increases when brought close to the material treated, the spacing of the panel from that material is sometimes arranged to be as little as two inches or even less.

FIGS. 11 and 12 show a hot air heat exchanger construction for house heating pursuant to the present invention. Here a cylindrical heat exchanger 800 has a hollow interior 802 in which is received a fibrous panel 804 also of generally cylindrical shape. The panel has an open end 806 clamped to a mounting plate 808 as by means of a rib 810 formed or welded on the plate and around which the panel end is squeezed by a split sheet metal strap 812 whose ends can be pulled together by a tightening screw 814.

Before the panel is fitted in place a partition disc 820, held on a tubular support 822 having an externally threaded extension 824 is mounted on mounting plate 808 which has a threaded aperture 826 that threadedly receives the threaded extension 824.

Partition disc 820 has its periphery located just above the edge of rib 810, to define a marginal slot 830 for discharge of a sealing gas stream through the marginal portion of the panel 804. An inlet nipple 832 provides for the delivery of the sealing gas stream to the sealing plenum 840 below partition disc 820. Extension 824 provides for the supply of combustion mixture to the plenum 850 above the partition disc.

Strap 812 is also shown as carrying a ring of outwardly-extending ears 842 that help retain a mass of insulation packing 844 fitted around the open end of panel 804 when mounting plate 808 is brought into engagement with the mouth 846 of heat exchanger 800. Some of those ears are also perforated to receive an ignition and test assembly 860 shown in the form of a series of ceramic tubes 862 each having an enlarged head 865 threaded into aligned openings in the mounting plate. Through the passageway in each ceramic tube there penetrates a rod 867 having a disc-shaped inner end 870 and staked as at 872 so that it is appropriately located with respect to the ceramic tube. A washer 874 can be slipped over each rod before it is inserted in the ceramic tube, to furnish better positional coaction with the tube and the staking. The outer edge of each rod can be threadedly engaged to a mounting tip 876.

The discs 870 of each rod are arranged so that they are in edge-to-edge opposition suitable for sparking and for flame detection, as described in connection with FIGS. 9 and 10.

The outside of heat exchanger 800 can be located in the circulating air plenum of a standard house heater, or if desired in a water tank containing water to be heated. This heat exchanger can be made of metal or even of glass, borosilicate glass being particularly suited when the heat exchanger is used to heat water. Water to be heated in this way can be colored with dyes for example, to better absorb radiant energy transmitted through a transparent heat exchanger. Metal heat exchangers are desirably ribbed to increase their effective surface area and thus increase their heat transfer to surrounding air or the like.

Thus the hollow interior 802 can be fitted with a coil of glass or metal tubing through which water is circulated to supply domestic hot water heating radiators. The tubing can also be extended up through the duct from which combusted burner gases are discharged to abstract heat from those gases. By arranging for the water to first flow through the tubing in the discharge duct and then through the irradiation zone 802, the water is efficiently pre-heated and the discharged gases cooled to as low as 180° F. or even lower. Such a low exhaust temperature is a measure of the high thermal efficiency thus attainable, and is partly due to the fact that the temperature of the combustion mixture where it burns on the outside face of fibrous matrix is about 1000° F. cooler than the combustion temperature reached without the help of the matrix. Also very little excess air is used with the burners of the present invention. An entire burner and heat-exchange assembly using the so-modified FIG. 11 need only be about one meter tall to supply the heat and domestic hot water for a three-bedroom home. Where such a home is heated by hot air, the tubing carrying the heated water can be run through the hot air plenum of a hot air distribution assembly to heat the air thus circulated through the home.

The water circulated in the tubing can be mixed with a little ethylene glycol or the like to avoid freezing and to increase its boiling point.

A gas exhaust at very low temperature might not create sufficient draft when merely discharged into a chimney flue. However the combustion mixture of the present invention is supplied to its burner under a few inches of water column pressure above atmospheric, and after burning leaves irradiation zone 802 at a small superatmospheric pressure that helps create a chimney draft. Additionally the blower used to deliver the combustion mixture to the burner can also have a tap that blows some excess air up the chimney flue to help draw the combusted gas up the flue.

At very low gas discharge temperatures, it is possible for moisture to condense out from the gas discharge. Such condensate can be permitted to run to the sewer.

Another feature of the present invention is the ability to use an inert or reducing gas to seal the combustion mixture on its way through the porous refractory panel. Thus the sealing gas can contribute to make the burnt combustion mixture provide an atmosphere of exceedingly low oxygen content, or even of strongly reducing ability as for example by reason of a significant hydrogen content.

FIG. 13 shows an annealing tunnel furnace 900 having upper and lower radiant heaters 902, 904 facing each other and held in fixed relation by side blocks 906 of thermal insulation. A wire mesh conveyor 908 is arranged to slide through the furnace interior to carry workpieces that are to be annealed or brazed. A strip curtain 910 closes off the entrance to the furnace, above the conveyor. The portion of the entrance below the conveyor is shown as closed by a one-piece wall 912.

The heaters 902, 904 are operated in the manner described above, except that the sealing gas streams, indicated by arrows 920, can be cracked ammonia, or a propane-nitrogen mixture, or pure propane or the like. With such sealing gases, it is preferable to adjust the combustion mixtures so that they have little or no surplus oxygen. The furnace interior then becomes a very effective reducing atmosphere that will prevent oxidation of the workpieces and even reduce any oxidation present on those pieces when they are introduced into the furnace. Notwithstanding the strongly reducing character of the furnace interior, the burning of the combustion mixture takes place very effectively to provide radiation at temperatures at least as high as red heat.

For high heat output from the furnace, the workpieces should be arranged to absorb larger proportions of the infra-red energy, as by packing them very close together in the conveyer 908, or by arranging for a workpiece to be a continuous length of material that spans the entire width of the burner faces.

The heaters of the present invention can be used for soldering with silver solder and even with soft solder, as well as for brazing. For soft soldering the heat requirement is relatively low and a flat-faced burner is more than adequate. Articles having extensive width, such as solar panels, can be very readily soft soldered by heating them with a row of burners, and in such arrangement the burners are preferably placed under the panel so that they are operated with their matrix facing upwardly. In this arrangement the naturally upward flow of combustion gases makes it unnecessary to have the special flow directing structure used for brazing.

Figure 14:
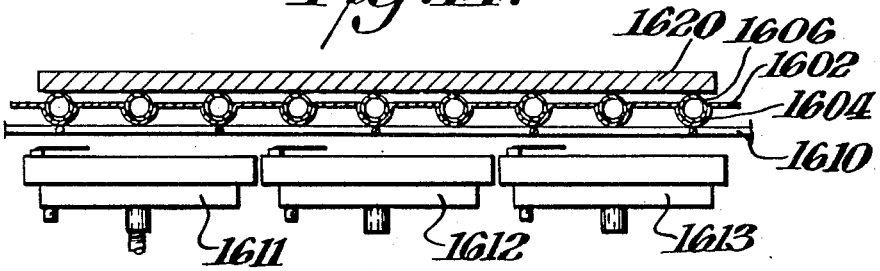
FIG. 14 is a view similar to that of FIG. 6 using an alternative array of burners within the present invention.

FIG. 14 shows such an arrangement in which a solar panel 1602 is provided with cylindrical depressions 1604 in each of which a length of tubing 1606 is to be soldered. The panel can be many feet in length as well as width, and the tubing even longer so that the tubing ends project beyond the panel and can be connected to fluid supply and withdrawal structure. The panel is held on a grid 1610 of narrow spaced metal strips, and three burners 1611, 1612 and 1613, or three rows of burners, each as long as the panel, are located below it. Because of technical difficulties in manufacturing as well as mounting a single burner matrix as long and wide as panel 1602, each burner is arranged to heat only a limited portion of the panel. A hold-down 1620 is arranged to press down against the tops of tubes 1606 and hold them in place in the depressions.

The depressions carry a quantity of soldering flux and powdered solder, and after a solar panel is mounted in position the burners can be fired and the hold-down pressed down. It takes less than a minute to thus complete the soldering of copper tubes having a 20 mil wall thickness to a copper sheet having a 10 mil thickness.

It is not necessary that the burners be fired at the same instant, so that standard electronic ignition timing arrangements are appropriate notwithstanding the fact that such arrangements can inject a time lapse of as much as 5 to 10 seconds between the light-off of the first and last burners. Indeed the outer burners can desirably be lit before the inner one, inasmuch as the heat losses are greater from the sides of the solar panel than from its center.

In the arrangement of FIG. 14, the depressions 1604 are shaped to extend somewhat more than halfway around the tubes, so that the mouth of a depression is slightly narrower than the maximum width of a tube. The tube will then snap in place in the depression and thus more positively be held in the desired position.

However it is not essential to lock the tubes in place. Indeed the tubes can be made with a D-shaped cross-section and the flat portion of their exterior can be soldered against a panel that has no depressions and can be perfectly flat.

To reduce the time required for heating the combination to effect sealing, hot gases such as combusted fuel gas, can be passed through the tubes, with the help of a manifold or header into which the tubes are fitted. The combination is preferably arranged to take place close to the manifold, and the combusted gases diluted with excess air to control the temperature and avoid overheating. At the end of the heating cycle, it is preferred to speed the cooling as by not only terminating all combustion, but continuing the flow of air alone through the burners as well as the tubing. It is also advisable to pre-solder the surface of the tubes where they are going to be soldered to the sheet, and to apply only a thin layer of flux to the sheet at the soldering locations. Alternatively the sheet surface can be pre-soldered.

Lengths of pipe can also be heated by flat-matrix burners, deployed in rows around the entire outer surface of pipes as long as 20 feet, for example. To speed such heating the hot combustion gases can be collected from around the burners and blown through the interior of the pipe, as by surrounding the burner assembly, or the spaces between adjacent burners, with conduit walls that direct the emitted gases to one end of the pipe so that they can be introduced to the pipe interior. The volume of space within large-diameter pipes can be reduced by inserting a mandrel into the pipe interior, so that the hot gases passed through it are confined adjacent the internal surface of the pipe. Swirling baffles can also be mounted around the mandrel to help make the gases moving within the pipe more uniform in temperature. It may be desirable to apply thermal insulation over the outer surface of the mandrel to reduce heat losses. The combustion gases exiting from the interior of the pipe being heated still have sufficient heat for preheating the next pipe to be heated, and for this purpose a pipe to be preheated can be coupled to a pipe being heated.

Burner assemblies such as those of FIG. 14 can also be arranged to fire face down or to fire facing any other direction. Thus they can be connected together to make a radiant roof for heating glass lehrs for example. One convenient arrangement of this type has a row of elongated burners each connected by its ends to the opposite arms of an overhead rectangular frame. The burners can be spaced a little from each other to permit burnt combustion gases to escape between them, or they can be packed together, preferably with thermal insulation strips squeezed between adjacent burners, to keep those gases from escaping upwardly.

The supporting arms of the frame can be made of metal tubing and can thus also be used to pipe to the burners their gas requirements. Thus the piping frame can carry an air stream which is fed to the air-seal chamber of each air-seal burner in the group, and which is also fed to a gas-air mixer that is separately supplied with gas that it mixes with the air to make a combustion mixture fed to the combustion mixture plenums of the burners. Alternatively the burners can have connections at their opposite ends for receiving the respective supplies, with these ends coupled directly to and opening into the opposed arms of the piping frame, one of these arms carrying air alone, and the other carrying the combustion mixture. Flow-control valves can be provided in the combustion mixture connections to the individual burners for adjusting the burning pattern for the row of burners.

The radiant roof assembly can have its burners with or without air seals and needs no covering over the tops of the downwardly facing burners. Without such covering the burner backs can be directly exposed to the external atmosphere so that those bare backs are thus subjected to very effective cooling by that atmosphere. If the maximum temperatures are desired for workpieces subjected to heating by the roof, it is preferable to use burners without air seals and packed together to minimize upward escape of the combustion gases.

Where combustion mixture is passed through a pipe exposed to heating as by the hot combustion gases, or by reflected infra-red radiation, such a pipe is best shielded by insulation to thus minimize danger of undesired ignition in such pipe. Ignition on the matrix surfaces is conveniently supplied by electric igniters, such as those described above which do not take up any space between burners, or such igniters can be mounted at one end or the other of each burner in the pack, and thus permit the long sides of adjacent burners to be brought into engagement with each other.

It is also helpful to reduce the curling or twisting effects caused by differential heating of portions of a burner. Thus burners that are about 4 feet long or longer are best built with extra stiffeners welded onto the burner body and these stiffeners are preferably welded to the inner face of the plenum where they are kept cool by the flushing action of the combustion mixture. A seven-foot-long and one-foot-wide burner body about 2½ inches deep, will show little or no curling even though made of 1/16 inch thick stainless steel sheet, when there is welded to inner face of its combustion mixture plenum a stiffening diffuser that extends the length of the body, as shown for example in U.S. Pat. No. 3,785,763. This is illustrated in FIG. 15. Welding a stiffener on the outside surface of the combustion mixture plenum will generally result in thermal curling apparently because the stiffener tends to heat up excessively in such a location. This problem is not so pronounced where the burner body is 5 or more inches deep or is made of ⅛ inch thick stock of plain carbon steel.

To minimize the thermal twisting of the matrix hold-down frame, which is a member that can get very hot, the matrix can be held in place by a succession of short lengths of angle metal. These can be for instance about 6 inches long, and spaced slightly from the adjacent lengths so that each length is free to expand somewhat as a result of the heating they normally experience.

The individual lengths of hold-down angle can be bolted directly to the back wall of the burner, rather than to the shelf on which the matrix is mounted, to further increase the rigidity of the burner. Such bolts preferably go through the air-seal plenum, as shown for the ignition insulators in FIG. 10, so that they do not have to be fitted to the burner by an air-tight engagement. A little extra air leakage around the bolts does no significant harm.

The short lengths of hold-down angle can also be pre-punched with a series of holes in one or both of their flanges, and these holes can be of a size to receive ignition wires or insulators as in FIG. 10. The shelf on which the matrix rests can also be pre-punched the same way. This simplifies the equipping of the burner with electric ignition; it is only necessary to drill out matching holes from the back wall of the air-seal plenum where the ignition connections are to pass through it.

The bolt holes are pre-punched through that back wall, and it is helpful for the bolt holes in the hold-down angle to be square and dimensioned to receive the square shank of a carriage bolt. Only one bolt per length is required.

The burners of the present invention provide very good radiant heating operation even when facing upward in dusty atmospheres. Combustible particles such as polyethylene are burned away as they fall on the burner matrix, and do not significantly affect the operation. The most serious effect of a dusty atmosphere is generally to disable an electric ignition attachment, and this can be minimized by running the electric current leads from the ignition site through to the air-seal plenum and then along that plenum and out through the air supply conduit connected to that plenum. At a location sufficiently remote from the dusty burner location the ignition wires can be run out from the air supply conduit and connected to the electric ignition control assembly.

To simplify the mounting of the burners, the backs of the burners can have mounting clips welded to them. A simple U-shaped clip can have its central span welded to the burner back to hold the arms of the clip projecting away from the back. These arms can be about an inch apart so that they receive between them a threaded mounting rod the ends of which are fixed in place. The arms can also be provided with small perforations near their ends through which a cotter pin or the like can be passsed on the far side of the threaded rod to hold the burner against the rod. Nuts can be threaded on the rod for engagement by the clips, so as to position the burner along the rod.

FIG. 16 illustrates the manufacture of corrugated board 1010 from a corrugated core sheet 1012, a lower face sheet 1014, and an upper face sheet 1016. Corrugating rollers 1041, 1042 corrugate the core sheet 1012 where these rollers mesh, and roller 1041 carries the corrugated sheet past an applicator roll 1046 that applies adhesive to the lower edge of each corrugation. Roller 1041 also presses the thus coated core sheet against the lower face sheet 1014 which is supported by a backing roller 1051.

Face sheet 1014 with the corrugated core sheet adhered to it moves to the right as shown in this figure, carrying the top of the core sheet past a second applicator roll 1047 which applies adhesive to the top edge of each corrugation. This assembly then is covered by the top face sheet 1016 introduced against the adhesive-coated corrugation after the lower face sheet is pressed at roller 1051, so that the adhesion of the top sheet is best reinforced by the application of heat.

To this end a burner 1000 is shown as held above the face sheet just down-stream of roller 1060, firing downwardly onto the face sheet. Only a few seconds exposure to such heating will set the top face adhesive. Heating can similarly be provided for the lower face sheet if desired. Also the freshly assembled sheets can be gripped by continuous conveyor belts pressing against one or both face sheets to more securely keep the sheets pressed as they advance to the heater and are withdrawn from it.

Burner 1000 is shown as provided with an electrically lit gas pilot light more fully illustrated in U.S. Pat. No. 4,272,238, but it can also be equipped with re-radiation and/or confining boards as in FIG. 11 of Ser. No. 186,491. It is also helpful to have an additional burner heating the lower face of the assembled corrugated board, as well a further burners preheating the lower face of sheet 1016 as well as the upper face of sheet 1014 just before these sheets reach the feed positions shown in FIG. 16. Of particular help is the orientation of the burner so that the hot combusted gases they generate become trapped in the corrugations and thus continue to supply heat after the corrugated sheet leaves the burner zone. Thus lower sheet 1014 can be fed upwardly rather than laterally to roller 1051, and an upwardly facing burner can be mounted under the corrugated sheet 1012 where it is carried by corrugating roll 1041 toward roller 1051.

The infra-red energy radiated by ceramic mat burners has a very high power density. It can for example cure a polymerizable silicone coating with as little as 5 seconds of radiation. It is also very effective for drying wet webs of paper or the like without the help of any steam-heated rolls.

The apparatus of FIG. 17 has a series of rows of downwardly-facing burners, three rows of which are shown at 1101, 1102 and 1103. A web of wet paper 1110 makes a series of passes at 1111, 1112 and 1113 below the faces of the burners, with the help of reversing rolls 1121, 1122, 1123 and 1124. The paper can then be wound up, or if further drying is needed can be exposed to additional burners or looped over steam cans or other drying equipment. If desired all or some of the reversing rolls 1121, 1124 can be internally heated as by steam or other fluid, to make the drying apparatus more compact.

Each row of burners has a set of relatively small side-by-side individual burners 1130 similar to the burner of FIG. 5 of Ser. No. 186,491. As shown in FIG. 18, each burner 1130 has a generally rectangular metal body 1132 of metal like aluminum that conducts heat very well, and with a wall thickness of about ⅛ inch so that it is thick enough to effectively conduct away excessive heat. In FIG. 18 the burner has a combustion mixture deflector plate 1134 supported by posts 1135 secured to the plate and to the back wall 1136 of the burner body. The burner body, plate, and posts are preferably brazed together, as by the molten flux dip brazing technique referred to in U.S. Pat. No. 4,272,238.

A single insulation block or pad can cover the backs of an entire row of burners, if desired, or can cover a single back or any other number of adjacent backs.

The burner sides 1155 that are aligned to make the leading and trailing burner edges across which the paper 1110 moves, are shown in FIGS. 18 and 19 as fitted with insulation blocks 1157 that are molded into angularly related flanges 1158 and 1159. Flanges 1158 are clamped against sides 1155 with the help of posts 1160 similar to posts 1135 that are only secured to the burner side walls. Insulation flanges 1159 flare outwardly from the burner faces, preferably at an angle of about 60 to 80 degrees from the vertical. The lower face 1163 of these flaring flanges can have its surface area effectively increased as by a succession of adjacent grooves 1161. The width of flanges 1159 is preferably from about ⅓ to about ½ the width of the burners, in order to take full advantage of the heating effects of the hot combustion gases discharging from the burner faces when the burners are operating.

As shown in FIGS. 17, 18 and 19, the hot combustion gases are kept by thermal deflectors 1162 from escaping over the free edges of the burner walls 1164 at the ends of each row. Deflectors 1162 can be mounted to walls 1164 the same way blocks 1157 are mounted, but the deflectors preferably extend downwardly lower than the bottom edges of blocks 1157, to a level below the path of the paper 1110. The hot combustion gases rise and will accordingly flow upwardly around the bottom edges of blocks 1157, as shown by arrows 1165.

FIG. 17 also shows exhaust ducts 1168 that collect the hot combustion gases which can then be used as a heat source for other operations or to pass through rolls 1121–1124 to heat them. Ducts 1168 can be provided with baffles 1169 that direct the hot gases over a few more inches of the paper 1110 before those gases are withdrawn.

Each individual burner of a row can have its own feed trimming valve 1170 that can be adjusted to offset uneven heating effects that may be caused by differences in the porosities of the matrix faces of adjacent burners. The burners in each row can be mounted with their adjacent sides in direct contact, as in FIG. 5 of Ser. No. 186,491, but preferably a compressible pad 1172 of thermally resistant material such as ceramic fibers is fitted between adjacent burners in FIG. 19. Such a pad about ⅜ inch thick compressed to half that thickness does not make too much of a gap in the incandescent surface defined by the burner faces, and it also helps to keep the burner-to-burner joints plugged against the leakage of hot combustion gases as a result of thermal expansion during operation.

The gaps between individual burners of a row can have their radiation interrupting effects reduced by shaping the burners so that these gaps extend at an angle with respect to the direction of paper movement. This will spread the radiation interrupting effect over wider portions of the paper, or even over the entire width of the paper.

The radiation interruption at the gaps is also reduced by a tapered thickness reduction at the free edges of the burner side walls, as shown in FIG. 31 of Ser. No. 94,901. The burner matrixes 1176 are sufficiently resilient that they can be squeezed into place against such tapered walls and thus effectively reduce the width of the outer lip of the wall to about 1/16 inch even though the balance of the wall is about ⅛ inch thick.

As pointed out above, the movement of the hot combustion gases over the flared surfaces 1160 heats up those surfaces to temperatures that come close to the temperature of the incandescent burner faces, particularly when those surfaces are of low density thermal insulation. The resulting high temperature of surfaces 1163 will accordingly generate additional infra-red radiation that helps dry the paper 1110. This additional drying is provided without increasing the amount of fuel used, so that the fuel efficiency is greatly improved.

FIGS. 18 and 19 further show the provision of a burner igniter in the form of a spark-fired pilot flame director 1178 as in FIG. 16. This can be provided with its own flame-detecting rod 1179, or if desired an ultraviolet detector 1180 can be fitted at the opposite end of a row of burners, to detect burner operation when the burners are being lit, and automatically shut down the gas feed if the burners do not ignite or if they should be inadvertently extinguished.

The grooving 1161 preferably has a depth of at least about ⅛ inch, and this depth can be as much ½ inch. The grooving effectively increases the surface 1161 as compared to a perfectly flat surface, and an increase of at least about 50% is desired. To this end the profile of the grooves can be triangular, rectangular, sinusoidal, or have any other shape.

The combustion gases discharging from the far ends of the surface 1161 can still be sufficiently hot to warrant their use as for heating a further radiating surface.

Thus those gases can be sucked through a porous insulator such as a ceramic fiber matrix positioned as an outer extension of surfaces 1161. The resulting relatively forceful flow of still hot gas through the porous matrix heats it up more effectively than the surface 1161 is heated, so that the heated face of the porous ceramic fiber matrix can contribute a significant amount of additional infra-red radiation.

The use of the surfaces such as 1161, with or without the foregoing extensions improves the operation of any fuel-fired burner that generates hot combustion gases. Thus burners 1130 can be replaced by ceramic tile burners, metal screen burners, or ceramic cup type burners, or even direct flame burners, and in each case the burner operation shows a similar improvement.

The individual burners 1130 in the assembly shown in FIG. 19 are preferably dimensioned so that different burners or groups of burners 1130 can be operated. In this way all the burners can be operated to heat a web 1110 of maximum width, and smaller numbers of burners can be operated to heat webs of smaller widths. Shutting down one or more burners has been generally effected with minimum construction cost by shutting off the flow of the propane or other combustible gas to those burners while permitting continued flow to those burners of the air otherwise mixed with that combustible gas to make the combustion mixture.

The same combustible gas shut-off has been used for emergency shut-downs, as for example when the web stops advancing and it is necessary to keep the stopped web from becoming charred by the burners. However such gas shut-offs are not prompt enough for certain stoppages such as when the web is a paper being printed at high speed with ink that requires heat treatment to dry rapidly. Such printing machines can be stopped in less than a second or two when there is an emergency such as tearing of the paper web. For such very abrupt stopping, it is preferred to rapidly trip shut the air supply to the mixer. This immediately stops the flow of combustion mixture and extinguishes the burner. The ceramic fiber matrix on which the combustion had been taking place, prevents flash back of the flame toward the mixing equipment and thus prevents damage.

The standard mixing equipment includes a so-called zero-pressure regulator which is designed to prevent flow of gas to the burner when the flow of air is interrupted, but when other types of mixing equipment is used, it is desirable to have the emergency shut-down at both the air flow and the gas flow. Electrically-operated solenoid valves made it simple to simultaneously and very abruptly shut off both those flows.

Such simultaneous shut-offs may also be desirable even when zero-pressure regulators are used for mixing. The use of a solenoid-operated gas valve is very helpful when an installation contains several burners some of which are to be selectively kept out of use on occasion. Also the closing of the gas valve permits simpler cycling of the burner safety system for relighting.

It is generally desirable to have the burners located below the work being irradiated inasmuch as the burner body is then not subjected to so much heating and the rising hot combustion products remain longer in contact with the work thus increasing the heating effect. In some cases however the only practical installation has the burner firing face down over the work.

Figure 20:
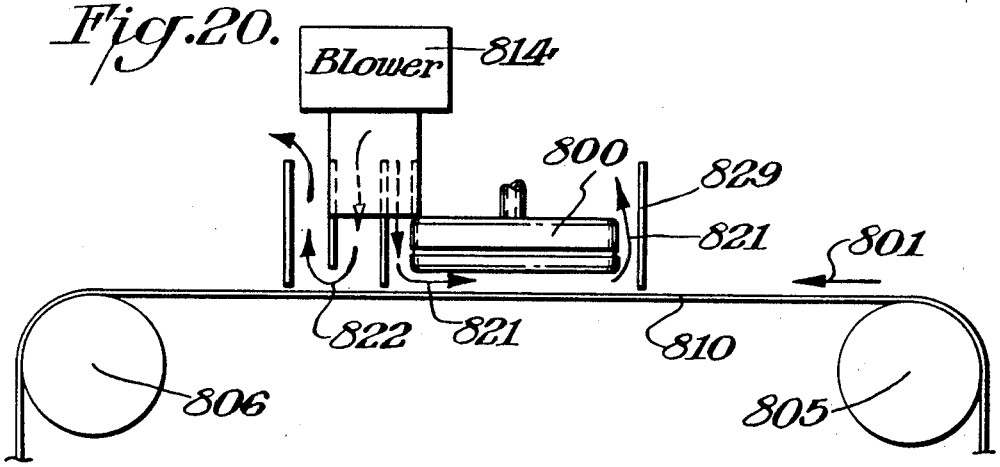

FIG. 20 shows an installation of this type in a portion of a paper-making machine preceding all or most of the steam can driers. A paper web 810 120 inches wide is here illustrated as moving in the direction of arrow 801 between two rollers 805 and 806. Over the web is positioned a burner 800 firing face down. To assist in the removal of moist air from adjacent the burner and thus speed the drying action, a blower 814 is arranged to blow a stream of low-humidity air between the burner and the web, as indicated by the arrows 821. This stream moves longitudinally of the web and transversely of the burner, countercurrent to the paper movement, and a baffle 829 can be provided to help deflect the stream away from the web after the air in it has become heavily laden with moisture.

Another stream of dry air 822 can be used to flow in the opposite direction along the web to further help remove from adjacent the web the moisture vaporized by the heat treatment. The burner and blower assembly can be placed under the web 810 facing upwardly, or two such assemblies can be used, one facing down from above and the other facing up from below. Instead of or in addition to blowing air against the web, suction can be used to help suck some or all of the hot combustion products and vapors along and away from the web. Air jets can also be used to move the combustion products.

FIG. 21 illustrates a modified arrangement used to heat paper or other webs that are moving vertically rather than horizontally. In such an orientation the hot combustion gases need not flow downwardly out of the bottom edges 1186 of the burner units, so that those edges can be relatively short lengths of insulation that are horizontal or only mildly flared—about 20 to 30 degrees down from the horizontal. Those lower edges can also be brought relatively close to the moving web 1189—about ½ inch—to limit the ingress of ambient relatively cool air into the hot combustion gases.

To improve the heating effect of the hot combustion gases they are withdrawn through a top exhaust duct 1182 and propelled by a blower 1183 to jets 1184 from which those hot gases are jetted against the moving web 1189. This breaks up the boundary layer barrier of steam or the like that can be present on the web.

The burners of the present invention dry paper with particular effectiveness. The radiation they emit is about as efficient in removing the last bit of excess water from an almost bone-dry paper, as it is in removing the first bit of water from a very moist sheet, and this permits an unexpectedly sharp drop in the bulk of a paper dryer.

However textile webs of cotton, wool, polyester, rayon, polypropylene, dacron and the like, or mixtures of such fibers, as well as plastic films are also very efficiently dried or cured with such burners.

A guide, such as plate 1129 in FIG. 17, can be used to assist with the threading of web 1110 past the burners in preparation for a drying run.

Infra-red radiation is also highly effective for preheating plastic sheets to prepare them for pressure or suction forming. Thus a continuous sheet of polystyrene or the like can be moved in steps toward a cutting and molding press that stamps out successive suitably dimensioned portions and successively molds them into shape, with the sheet subjected to any of the irradiation arrangements described above immediately before it reaches the cutting and molding press. By making the irradiation zone equal in sheet travel length to the length of each sheet advancing step, uniform pre-heating of the sheet is obtained.

Where it is necessary to limit the amount of pre-heating so that an incandescent radiator surface must be substantially smaller than the length of an advancing step, the advancing sheet can be arranged to first advance at an uninterrupted uniform rate past a short irradiation zone, and to then be carried as by a tenter frame assembly that permits stepwise feeding to the cutting and molding press.

In the event the preheating tends to cause the plastic sheet to shrink in width or length, the heated sheet can be placed under tension, transversely or longitudinally or both. To this end a tenter frame type step advancing means can be provided with weighting rolls to apply longitudinal tension to loops of the sheet, and can additionally or alternatively be fitted with clamps that grip the side edges of the sheet and in this way apply transverse tension.

Burning a gaseous hydrocarbon fuel at the surface of a ceramic fiber matrix has been found to yield exceptionally small amounts of carbon monoxide and nitrogen oxides. Burners of this type are accordingly highly suited for industrial and domestic space heating by merely facing the incandescent matrix toward the space and the people to be warmed. The gaseous combustion products leaving the matrix can thus be permitted to enter and diffuse through the space being warmed, without increasing the carbon monoxide and nitrogen oxide content of the air in the space as much as it would be increased by open flames of conventional fuel-fired heaters or even cooking ranges. A matrix type space heater is accordingly very inexpensively installed. Since it is also a very effective generator of infra-red energy and warms both through such infra-red generation as well as by the heating effects of its hot combustion products, it also makes a highly efficient installation.

If desired such a space heater can be equipped with a hood that collects its combustion products as they rise from a laterally directed vertical matrix face, for example, and vents them through a chimney or stack. Inasmuch as matrix combustion is essentially stoichiometric there is essentially no excess air in those combustion products so that the cross-sectional area of the stack or chimney can be quite small.

Where burner bodies are to be kept as compact as possible as for example when mounted in a confined space as in FIG. 6 of Ser. No. 186,491, a burner can have the construction shown in FIGS. 22 and 23. In this construction the burner 1302 has no air-seal, and its matrix 1304 is fitted directly in the open mouth of an open burner box 1306, as in FIG. 5 of Ser. No. 186,491. The burner box can have a gas-tight construction and be made of aluminum or stainless steel, or plain carbon steel. Before inserting the matrix, there is mounted in the burner box a set of partitions 1311, 1312, 1313 and 1314 that encircle its four walls. Each partition is shown as L-shaped in cross section with the short arm of the L positioned to form a ledge 1320 against which the matrix rests. Such a shelf need only be about ½ inch wide and makes a very desirable stop that keeps the matrix from penetrating too deeply into the box when the matrix is installed. The matrix is preferably cemented in place in the manner described above.

Partitions 1312 and 1314 are shown as extending the full length of the interior of box 1306, while partitions 1311 and 1313 extend from partition 1312 to partition 1314. Openings 1322 are punched in the ends of partitions 1312 and 1314 so as to interconnect the chambers formed between the partitions and box wall. One partition end 1330 can remain unpunched and inlet and outlet tubes 1335, 1336 fitted in the wall of the box on opposite sides of this unpunched end, for the introduction and removal of a cooling fluid.

The partitions are installed by dip-brazing or welding, so that the coolant chambers they form are gas tight. The cooling fluid can be tap or deionized water, where the chamber walls are stainless steel or aluminum. Some boiling point depressant like ethylene glycol can be added to such water, particularly where the interiors of the coolant chambers are as narrow as ⅜ inch inasmuch as parts of the box wall can then reach a temperature above the normal boiling point of water, when the burner is in operation. Such an additive also reduces the danger of freezing when the burner is not operating and is exposed to a very cold climate.

It is also helpful to add a corrosion inhibitor such as zinc chromate to coolant water if that water comes into contact with plain steel or even aluminum.

The coolant inlet and outlet tubes are shown as emerging from the back wall of the burner box, but they can instead be fitted to a side wall, as where not enough space is available in back of the back wall. The combustion mixture inlet 1340 is also illustrated as fitted in the back wall and can likewise be moved to a side wall. Such a side wall mounting can have the combustion mixture inlet penetrate through the box side wall and through the adjacent partition, but if desired that partition can be interrupted so that it does not extend over such a side-wall installation, or that partition can be completely omitted.

The burner of FIGS. 22 and 23 can also be made by a casting technique as in Ser. No. 509,161 so that all of its metal structure or outer metal structure is formed in one operation. Its coolant chambers can also be enlarged and brought into close heat-exchange relation with the incoming gaseous combustion mixture, so that the coolant need not be supplied and withdrawn to keep it from overheating. Instead the enlarged coolant chambers can be kept disconnected from circulation conduits and have fins on their combustion-mixture-contacting surfaces for better heat-exchange with the combustion mixture. In addition such chambers can have their coolant contents exposed to the atmosphere so that it can boil a little if overheated.

Partitions 1308 can be made of simple flat sheets welded or brazed in place, instead of L-shaped members. Such flat sheets can span the corners between the back and side walls of a pre-formed burner box, and need not provide a ledge for the matrix.

Figure 24:
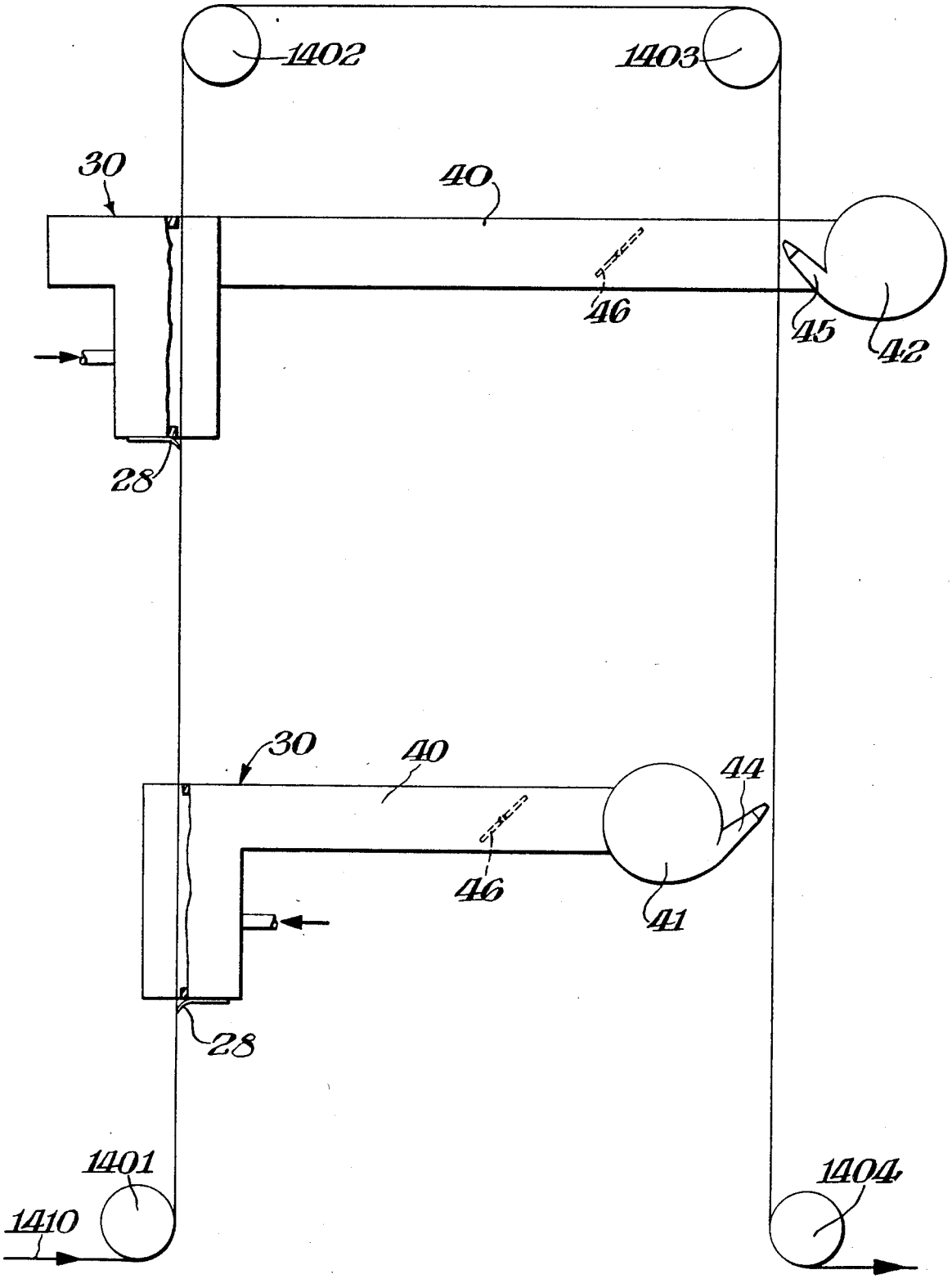

FIG. 24 illustrates a very effective pre-dryer of the present invention. This pre-dryer has four rolls 1401, 1402, 1403 and 1404 that guide a freshly dyed textile web 1410 to a set of steam-heated drying rolls (not illustrated) where the final drying is effected. Between rolls 1401 and 1402 the web moves upwardly and in this travel each of its faces is irradiated by a heater assembly 30 illustrated in FIG. 1 of Ser. No. 186,491. Each of these assemblies has a draw-off conduit 40 through which gaseous combustion products that are still quite hot, are withdrawn. These conduits 40 lead to the intakes of blowers 41, 42 which have their discharge outlets 44, 45 directed to rapidly blow the discharged gases against the textile web as it descends between rolls 1403 and 1404.

The heater assemblies 30 can each have a scoop 28 that not only improves the drying action but also helps keep the web from fluttering as it moves upwardly. Such fluttering generally takes place, sometimes to a dangerous degree, in pre-dryers that have a substantial span between rollers 1401 and 1402.

The discharges of blowers 41 and 42 are preferably arranged to propel against the textile web, streams of hot gas at a velocity of at least about 10 linear feet per second. The velocity brings the hot streams in very good heat exchange relation with the web. The heat exchange relation is also improved by inclining the hot streams about 30 to about 60 degrees upwardly. An enclosure can be provided around the downwardly moving textile web to help confine the blown streams near that web as they move upwardly alongside it.

FIG. 24 also shows an adjustment device in the form of a damper 46 in conduit 40. This damper can be opened or closed to provide the optimum drying effect. Thus the re-radiator 26 of assembly 30 will supply the best heating when it is at the highest possible temperature, and damper 46 can be adjusted while the surface temperature of the re-radiator is measured with a pyrometer. Opening the damper too wide can increase the suction in the discharge plenum 35 so much as to draw ambient air in through the re-radiator and this will cool down the re-radiator surface. On the other hand closing the damper too much reduces the volume of hot gas blown through the pump outlet. Optimum drying is generally effected when the damper is as far open as it can be set and still keep the re-radiator surface very hot.

Only one drying assembly can be used in the apparatus of FIG. 24, or conversely a large number of them can be used so that little or no steam roll drying is needed.

As shown in FIG. 25, the infra-red radiating burner 1510 can have a Bernouilli airfoil floating dryer 1601 preceding it in the path through which web 1502 moves during the drying. Dryer 1601 is an elongated box that can be generally rectangular in cross-section and provided with a very narrow slot 1610 through which a stream of heated gas such as air is expelled at a velocity of ten to fourteen thousand linear feet per minute. The slot lips 1611, 1612 are shaped to divert the expelled stream at an acute angle, about 30 to 60 degrees away from the box wall 1613 that forms upstream lip 1612. At such stream velocities the stream moves along the surface of substrate 1502 and develops Bernouilli forces that urge the substrate toward, but also hold it short a fraction of an inch from wall 1613. This type of gas flow is rather turbulent and very effectively subjects the substrate to the drying action of that stream.

The gas stream for dryer 1601 is preferably taken from the hot combustion products discharged by burner 1510, as by enclosing the combined dryer structure in a housing into which all the hot gases flow, and from which a blower blows some of those gases into the interior of the box of dryer 1601.

Dryer 1601 is shown as directing its discharged stream counter-current to the movement of the substrate but an alternatively discharge its drying stream in the opposite direction so that it moves co-current with the substrate. Moreover, two or more such Bernouilli airfoil dryers can be fitted to the leading wall of burner 1510, and these can have their gas streams all directed counter-current, or all co-current, or some one way and the remainder the other.

Another Bernouilli airfoil dryer 1602 is shown as fitted to the exit end of dryer 1510 and can operate like the preceding dryer or dryers 1601. Also, the re-radiator panel 1560 can be eliminated along with its mounting structure, so that the exit Bernouilli airfoil dryer 1608 directly follows irradiating burner 1510. The Bernouilli airfoil drying combination does not require the build-up of any significant depth of hot gases under the burner matrix or under the re-radiation panel, if used.

A preferred modification of the construction of FIG. 25 is illustrated in FIG. 25A. Here a set of Bernouilli airfoil guides 1603, 1604 are secured to the respective upstream and downstream ends of a burner combination 1605 containing four burners 1610, 1611, 1612 and 1613. Centrally of the burners is an exhaust gas flow-through box 1615 whose lower wall is a porous re-radiator panel 1616 corresponding to panel 1560 of FIG. 1.

Airfoils 1603, 1604 are arranged to direct their discharged air streams towards the burners adjacent to them, so that they not only guide the web 1502 but also flush toward the exhaust gas flow-through box all of the hot burner combustion products along with whatever vapors are expelled from the web by the heating action. In many cases the web contains combustible solvents or the like when it enters the apparatus, and those contents are vaporized by the heating action. These vapors are kept from significant leakage to the atmosphere, and are swept toward box 1615. When those vapors are oxidizable they will be oxidized, generally by the time they reach panel 1616 so that only oxidation products are discharged from that box. The heat content of the thus-discharged products is recovered in a heat exchanger 1617 where they heat up an incoming stream of fresh air blown through by blower 1618. The resulting heated air is supplied to the airfoils 1603, 1604, and thus supplies oxygen for the oxidizing process as well as any additional heating of the web.

Skirts 1619 depending from the side edges of the burner combination 1605 help keep the airfoil discharges and burner discharges from escaping at the side edges of the web. As in the construction of FIG. 1, panel 1616 can be impregnated with oxidation catalysts such as platinum or palladium to assist with the oxidation of vapors.

FIG. 26 shows a heat-treating apparatus 10 for drying porous fabrics such as non-felted open webs of long-fibered thin sheets. Such a web 12 is delivered from a web-forming station for example, is received on the upper run 14 of an endless conveyor belt that carries the web through a heating station defined by a burner assembly 18. Assembly 18 is a collection of gas-fired burners 20, 21, 22, 23, 24, 25, 26, 27, 28 and 29, each extending across the width of the web 12 facing downwardly to heat the web as it is carried by the conveyor. The burners can be built along the lines shown in Ser. No. 186,491, but are mounted in pairs each pair being spaced from the next to provide gaps 31 that also extend the width of the web. A set of idler rolls 33 helps support the conveyor run 14, and as shown these rolls are preferably located where they do not receive the full blast of the infra-red energy generated by the burners.

Conveyor 16 is porous and is made of strands that withstand temperatures up to 400° F. or 450° F. A metal mesh conveyor belt can be used, but meshes of thermally resistant cords are particularly desirable since they do not carry off so much heat and the cords themselves are somewhat transmissive of infra-red energy. Also a fabric mesh conveyor is very light in weight and is much simpler to operate. Belt thickness as little as 1 millimeter are all that is needed. Aramid, qiana and other temperature-resistant fibers, tire cord grade Kevlar fibers for example, make good conveyor cords, and even nylon fibers can be used where they are not heated above about 250° F.

The conveyor face that receives web 12 is preferably coated with poly(tetrafluoroethylene) to minimize the danger of the web sticking to the upper run particularly when the web arrives in wet condition.

A series of suction boxes 41, 42, 43, 44, 45 and 46 is placed below the conveyor run 14, with their suction mouths 39 very close to or even contacting the lower face of the conveyor there. Mouths can be made of poly(tetrafluoroethylene) to minimize friction. The boxes are connected to a suction manifold 37 at one or both sides of the apparatus, and these manifolds are in turn connected to a suction blower. Between the suction boxes there is fitted infra-red re-radiators which can merely be sheets 44 of thermal insulation opaque to infra-red. The upper surface of these sheets have some of the burners' infra-red energy impinged on them through the porosities in the web and in the conveyor, and those surfaces are thus heated and themselves radiate infra-red energy. That re-radiated infra-red energy helps supply additional heat to the bottom of web 12.

The fibers of which web 12 is made, may also be partly transparent to the infra-red generation, and thus permit more infra-red energy to reach the re-radiators.

The application of suction to the interiors of the suction boxes causes them to suck in gas through the porosities in the web and in the conveyor. Some of the very hot gaseous combustion products discharged by the burners are thus drawn through the web to further increase the heating effect. Also where the web is wet with water or contains any other volatilizable material, the movement of the sucked gases through the web greatly increases the removal of such material.

The gaps 31 between burner pairs permit the dilution of the hot combustion products with ambient air from between the burner pairs, so that mixtures of these two gases can be sucked through the web. Such mixtures can have temperatures much lower than the undiluted combustion gases, and some webs can be damaged by such undiluted gases. At the gaps the burners can carry adjusting devices such as slides 48 that can be shifted to cover or partially cover the gaps.

The degree of suction at the suction box mouths can be selected between about 1 and about 200 inches of water column, and the burner mouths sized to cause all or only some of the hot combustion gases to be sucked through the web, with or without dilution by ambient air. To help assure that all of those hot combustion gases are available to be sucked through the web, the burners can be fitted with end skirts 50 that extend downwardly more than the side walls 52. This causes the hot combustion gases to build up under the burner face until they spill out below the bottoms of the side walls.

The conveyor strands or cords preferably provide spaces of about 1 to about 4 millimeters between them, and such openings will not have any significant effect on the manner in which the web is supported by the conveyor. The side margins 56 of the conveyor can be made with less or no inter-strand spacing, and can be completely coated to strengthen it against tearing. An impervious edge boundary so provided also helps confine the boundaries of the suction effects and reduces suction losses.

The assembly of FIG. 26 can be mounted in a framework 60 only about 18 feet long, and does a drying job about as effective as 15 steam-heated drying rolls each 5 feet in diameter. Shorter burner assemblies can be used if less drying is desired.

The individual burners 20, 21, etc. can be of the air-seal type or of the non-air-seal type, both described in Ser. No. 186,491. Air-seal burners discharge significant amounts of air around the hot combustion gases, so that those gases are cooled somewhat by the discharged air before they flow out past side-walls 52. The air-seal flow can if desired be increased to the point that no additional ambient air is needed at gaps 31.

The burners are shown as of the ceramic fiber type, that is they have a porous felted ceramic fiber mat through the thickness of which is passed the gas-air combustion mixture to be burned, and the mixture burns as it emerges form the mat. This burning heats to incandescence the fibers at the face from which the combustion mixture emerges, and these incandescent fibers generate the infra-red energy which is so effective. However other types of gas-fired infra-red burners can also be used, such as those that have ceramic plates heated to incandescence by gas flames, or those that have metal screening heated to incandescence. So-called catalytic burners are not desirable inasmuch as they are intended for operation at temperatures too low to do a good job of heating webs.

Assembly 10 may also be provided with a hood 66 that can be fitted with a blower to collect and remove combustion products and vapors. The web path in assembly 10 can be tilted rather than horizontal, so that the web moves in a direction inclined upwardly or downwardly, or even perfectly vertical.

FIG. 28 shows a burner assembly particularly suited for heat-treating moving webs carrying volatilizable material that contaminates the atmosphere if merely discharged into the air. Here a web 124 of freshly painted or coated paper as it moves from the painter or coater is passed under a heat-treater 110, and can be supported by a conveyor belt 125 or a series of idler rollers, or even a fixed supporting surface.

Assembly 110 contains a gas-fired burner 120 firing downwardly and having its incandescent face 150 spaced at least three, preferrably four, inches from the paper web. On opposite sides of the burner are draw-off boxes 112, 113 having floors covered with porous re-radiators 114 as described in Ser. No. 186,491.

Upstream of draw-off box 112 is a thermally insulating partition 122 that descends to about one inch or less from the paper 124, to provide an entranceway 128 for a shallow stream 140 of flushing gas delivered through external conduit 126. The upstream lip 129 of conduit 126 is even closer to the paper 124, than partition 122.

Downstream of draw-off box 113 is another thermally insulating partition 130 extending downwardly toward the paper. The lower edge 131 of this partition is as far from, or a little farther from, the paper as the lower edge of partition 122. Downstream of partition 131 is a collection chamber 115 defined by wall 130 along with side walls 116, 117 and a far partition 132. An end wall 134 further downstream provides another external conduit 136, and like external conduit 126 the lower lip 137 of the external wall 134 of conduit 136 is located very close to the paper 124.

External conduits 126, 136 can be continued through side jackets 139, and can be interconnected that way to provide a peripheral enclosure through which gas is flowed downwardly to act as a curtain along both edges of the paper as well as upstream and downstream of the assembly 110. Upstream conduit 126 preferably has a depth in the upstream-downstream direction somewhat greater than that of the downstream conduit 136, so as to provide the extra gas that makes the shallow stream 140.

Both conduits 126, 136, as well as the peripheral jackets, are provided with intake connectors 141 and supply ducts 142, the latter being shown as joined together and forming the outlet for a blower 150. The intake 152 of the blower is fed from ducts 154 connected to draw-off boxes 112, 113. A heat exchanger 160 can be fitted in ducts 154 to cool the gases sucked from boxes 112, 113 into the blower.

The apparatus of FIG. 28 is operated by introducing a stream of gaseous combustion mixture intor burner inlet 101, igniting the combustion mixture as it flows out from face 150, and passing the paper 124 to be treated under assembly 110. Ignition is conveniently effected by sparking using the electrode arrangement described above in Ser. No. 186,491.

Blower 150 is operated to suck the very hot combusted gases through draw-off boxes 112, 113 and after they are cooled to about 400° F. or below, to blow them through conduits 126, 136, and the side curtain jackets 139. This provides the shallow stream 140 that flushes across the surface of the paper and carries off vapors of organic printing or coating solvent or the like. Stream 140 with those vapors is in turn drawn off through chamber 115 and can then be led to a separator for separating out those vapors, as by cooling to condense them out as liquids.

The path of the gaseous combustion products as they leave the burner face 150 and move to the draw-off boxes as shown by the plain arrows 170. The path of the shallow stream is shown by the primed arrows 171.

Burner 120 is shown as a ceramic fiber matrix type burner, and can be fed a gas-air combustion mixture that is exactly or approximately stoichiometric. Its combustion products will then contain little or no oxygen, and the gas-containing effected by the gas curtains in the construction of FIG. 28 will sharply restrict or completely prevent the leakage of oxygen-containing air into those combustion products as they move through the above-described circuit. There is accordingly little or no risk of explosion even when the vapors swept from the paper are highly combustible in air. Wire screen burners also provide similar stoichiometric control of oxygen in their gaseous combustion products.

Stream 140 is preferably kept as shallow as practicable inasmuch as this reduces the volume of gas mixture from which the vapors are to be separated. Some of the combustion gases leaving burner face 150 can be bled off to the atmosphere downstream of blower 150, in the event the gas curtain around the periphery of assembly 110 does not dissipate all the excess gas.

Burner 120 is desirably of the air-seal type having around its margin a sealing plenum 110 described in the Japanese application. Although this plenum can be fed air at its intake 168 without adding too much oxygen to the burner's combustion products, it can also be fed with recirculating combustion products. Temperatures as high as 350° and even 400° F. can be tolerated for gases fed to the sealing plenum 110.

Alternatively the gas supplied to seal plenum inlet 168 can be some of the gas separated from the gas-vapor mixture. Thus where the vapor separation yields a recovery stream of vapor-contaminated gas with or without a separate stream of vapor-free gas, the contaminated gas can be fed to plenum 110. In the event the contaminating vapor is carbonized or converted to other undesired solids by the hot combustion gases, a little extra air can be added to the air-seal gases to help burn up such solids.

Heat exchanger 160 can be used to provide heat for other purposes. However the combustion mixture entering burner inlet 101 can be heated somewhat by heat exchanger 160 inasmuch as a limited amount of such heating, i.e. to bring the incoming combustion mixture to about 200° F., will not damage the burner and will actually increase its thermal efficiency. Where the vapor is combustible and not sufficiently valuable to be recovered, gas-vapor mixture can be supplied from chamber 115 to seal plenum intake 168, after only a little cooling. Such recycled vapor will be burned as it enters the combustion zone of burner 120, and where its combustion products are only oxides of carbon and hydrogen, does not create any problems. The content of vapor in such recycled mixture is generally too low to call for an adjustment of the air-to-gas proportion fed to burner 120, but such an adjustment can be made if desired.

The shallow flushing stream 140 is substantially cooler than the hot gaseous combustion products above it as it passes beneath the burner, and so tends to remain close to the paper even if it becomes further heated during such passage. Some movement of the hot combustion products into the narrow stream 140 can be tolerated, but it is preferred not to have any of the stream 140 work its way into a draw-off box 112 or 113. A temperature difference of at least about 400° F. between the stream 140 and the hot gaseous combustion products discharged by burner 120, is quite effective for this purpose.

Where more assurance is desired that stream 140 stay in place, or where that stream is to be made as shallow as ½ inch or shallower, a thin sheet of infra-red transmitting material such as quartz can be fitted between partitions 122 and 130 to help contain that stream. In such an arrangement the temperature difference between stream 140 and the hot combustion products above it, can be less than 400° F. The shallow stream should however not be so hot as to damage the paper 124.

The face of burner 120 becomes quite hot in use, and any metal members exposed to that heat are preferably covered with thermal insulation, as described in the Japanese application, and the metal subdivided into sections that are spaced from each other to better allow for thermal expansion and contraction. Metal supports or retainers for thermally insulating partitions and the like can be similarly subdivided.

A belt conveyor used with the construction of FIGS. 28 and 29 can be of the types described above in connection with FIGS. 26 and 27, but does not have to be porous.

Where the paper 124 or other material being heated is moving at a very rapid rate or contains very large quantities of volatiles, a second assembly 110 can be mounted at the downstream end of the first assembly to provide more heating and more vapor flushing. Conduit 136 of the second assembly can then be eliminated inasmuch as its sealing function is not needed. The shallow flushing streams of both assemblies can be kept separate, or can be combined as by also eliminating chamber 115 from the first section, or the conduit 126 of the second sections, or both.

In the event the paper 124 is to be printed or coated on both faces, a separate assembly 110 can be arranged to separately treat each face.

The web to be treated can also be moved in an inclined or vertical direction. Where there is an appreciable inclinition of the web path, the lower draw-off box for combustion products can be omitted and the upper one made larger. For vertically-moving webs both faces of which need treatment, a separate burner assembly can be applied against each face, with the shallow vapor-flushing stream moving upwardly or downwardly. Preferably the flushing streams move counter-current to the web.

Webs can have their lower faces treated in the manner shown in FIGS. 28 and 29 as by using an inverted burner assembly having an inserted infra-red-transmissive gas barrier close to the lower face of the web. The shallow vapor-flushing stream will then be above the burner; and applying a small superatmospheric pressure to that stream will help keep the web being treated from sagging too much.

The webs printed or coated on one face, can have their opposite faces exposed to the infra-red irradiation, with a shallow stream of vapor-flushing gas directed along the printed or coated face. The web itself will then separate the vapor-flushing stream from the combustion gases produced by the infra-red generation. Where the webs are somewhat transparent to the infra-red energy, damage by overheating is easily controlled by limiting the radiation. Special cooling of the web is accordingly not needed unless the web is quite thick. The heat treatment can be immediately followed by cooling with very cold air or by engagement with a water-cooled roller, to shorten the time during which the web remains hot. Such cooling is best applied to the face that was irradiated.

Where it is desired to recover the vaporizable solvent in more or less anhydrous condition, the vapor-flushing gas should have a minimum of moisture content. Using unsaturated fuels such as pentadienes, butadiene, pentylenes, butylenes, propylene and/or ethylene, to fire the burners, yields combustion products having much less moisture content than that resulting from burning natural gas. The moisture content of those combustion products can be further reduced by passing those products through a moisture reducer such as steel wool which reacts with water vapor at elevated temperatures. Such reaction converts the reacted water vapor to hydrogen in amounts that can be over 10% by volume of the resulting combustion products.

Alternatively, the heat exchanger 160 can be used to cause the hot combustion products to heat oxygen-poor gas such as that recovered after freezing out the solvent vapors. This heated gas is then passed through duct 152 to form the shallow vapor-stripping stream. A gas stream so supplied would have its water vapor frozen out along with the solvent vapors.

The draw-off boxes 112, 113 of FIG. 28 can also be used alongside the burners of the FIG. 26 construction. The suction blower 150 and/or heat exchanger 160 can also be added to such a modified FIG. 26 construction. By confining essentially all the hot combusted gases, these gases can with or without dilution by ambient air, be fed to a discharge slot above the web 12 and directly over the mouth of a suction box 42, both fitted close to the web so that the suction in that box directly controls the flow of combusted gas into a draw-off box. The suction blower can then be controlled to draw off as much of the combusted gas as desired, or to adjust the temperature of the gas drawn through the web 12. An adjustable air bleed can be provided to help with such temperature adjustment.

The foregoing control can be made automatic as by providing a temperature sensor in thermal contact with the draw-off gases as they are directed against the top of web 12. For some webs these gases should not be hotter than about 400° F., and the temperature sensor can be connected to open an air-bleed into the drawn-off gases when that temperature is exceeded, and close down the bleed when the temperature is below 400° F. Such air bleed can be located in the draw-off boxes or in the suction boxes.

The foregoing control is made more complex when the burner generating the hot combusted gases is itself operated in a variable manner. Thus the temperature of the web can be measured as it approaches the first burner or as it approaches each burner, and the burner automatically turned up or down to compensate for the condition of the web. A non-woven fiber web 12 having a resin binder may for example have to be heated to 275° F. to be fully cured, so that the burners can be adjusted to make sure a proper cure is effected and the web not overheated. Any such burner adjustment changes the rate at which the hot combusted gases are generated. For maximum efficiency as much as possible of these hot gases should be sucked through the web, so that the suction blower can be coupled to the burner combustion mixture flow control. This will cause changes in burner operation to also cause corresponding changes in suction.

A separate blower can be provided for sucking the hot combustion gases through the draw-off boxes into a compartment above the web. This high-level blower can have an automatic temperature-responsive control that responds to the temperature of the gas entering the draw-off boxes. A small micro-processor can be provided to automatically vary the high-level blower operation when the burner operation is not being changed, and to stop when the temperature of the draw-off air reaches a maximum. Such maximum indicates that all the available hot combusted gas is being sucked into the draw-off boxes. The micro-processor is preferably connected to automatically start an exploratory variation in the direction indicated by the direction of a burner variation that has just been completed. Thus turning up the burner liberates more hot gas so that the initial micro-processor variation that follows should be in the direction that increases the draw-off of such gas.

The low-level suction blowers that provide suction for the suction boxes are coordinated with the burner operation so that the suction is at all times strong enough to draw through the web all of the hot combusted gas emitted by the burner. However this flow of gas is tempered before reaching the web, by an air bleed that responds to the temperature of this gas as it approaches the web. In the event that temperature is higher than the web can tolerate, the air bleed is opened to permit more and more ambient air to enter the approaching air, and in the event that temperature is lower the bleed is closed. As the air bleed is opened, more gas plus air becomes available to pass through the web, so that the low-level suction blower can then be varied to pull more.

Burners other than of the ceramic fiber matrix type can be used in place of burner 120, and a ceramic fiber burner without an air-seal such as described in FIGS. 2, 3 and 4 can also be used. Alternatively cooling of the metal structure of the burners of FIG. 26 and FIG. 28 can also be arranged as by having water conduits brazed to that structure as described in Ser. No. 186,491.

The infra-red heating of the present invention can be applied as the first or the last heat treatment stage of a wet web, or at any intermediate point in the drying of the web. Because the gas-fired burners have an exceedingly high power density and can be made of almost diminutive size, they can be readily fitted into compact spaces and retrofitted in many prior art types of dryers.

Figure 29A:
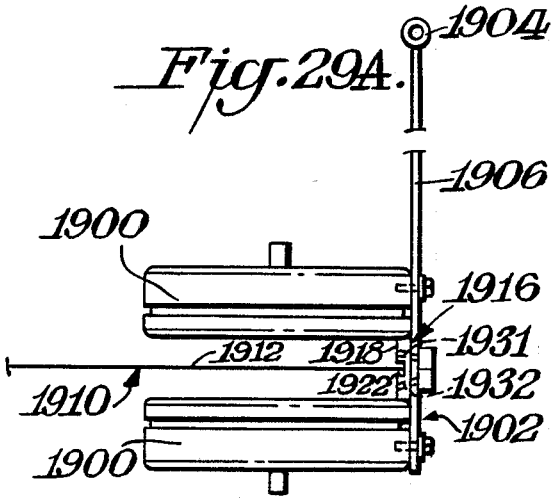

The construction of FIG. 29*a* is used to help dry one or both edges of a paper web. When paper dryers are fed with undryed paper wider than preferred, the outermost few inches of the edges 1912 of the paper generally do not dry sufficiently. According to the present invention narrow burners 1900 are placed over and/or under one or both edges 1912 to more closely equalize the drying in such an installation.

In FIG. 29*a* two burners 1900 are shown as held on an outer carry plate 1902 that is pivoted from overhead pin 1904 by means of an elongated beam 1906, so that the burners can be pivotally retracted from the illustrated position, to simplify the threading of the paper web 1910 through the dryer. The burners are easily restored to their illustrative operative position where they are latched in place.

The fuel supply conduits to the burners 1900 are made flexible to yield with the foregoing pivotal action or the conduits can be provided with swivel joints, the swivel axes of which are aligned with pin 1904, so that the portions of the conduits secured to the burners can pivot with the burners. Where the burners have air-seal margins, a blower can be mounted on one of the burners 1900 or on carry plate 1902 or beam 1906, to supply a stream of air for the air-seals, and if desired all the air for the combustion mixtures as well.

Carry plate 1902 is also shown as holding a pad 1916 of thermal insulation such as one made of felted ceramic fibers. This pad is not needed, but if used improves the drying efficiency by acting as an absorber and re-radiator of infra-red rays. It absorbs infra-red radiation emanating from the faces of burners 1900 and its surface 1918 becomes quite hot in doing so. This hot surface re-radiates infra-red energy to the surfaces of paper edge 1912 without losing much heat by conduction to the relatively cool carry plate 1902. Pad 1916 can be grooved as shown at 1922 to permit the paper edge to completely block direct radiation from one burner face to the other.

Passageways 1931, 1932 can be provided through the carry plate 1902 and through the pad 1916, so that the faces of the burners can be observed and thus monitored to assure proper operation. Automatic monitoring can be arranged by fitting a light or ultra-violet sensor to the passageways, and connecting them to automatically shut off all fuel flow to a burner whenever the burner face is not lit. For lighting the burners electric ignition such as shown in U.S. Pat. No. 4,157,155 can be used, or if desired pilot flames, with manual controls to override the sensors.

Groove 1922 can be flared to better permit radiation to reach the extreme margin of the paper. Burners 1900 can also be equipped with scoops and/or extensive re-radiator panels as in Ser. No. 186,491 and/or confining boards such as 1516 in FIG. 1.

Where two burners 1900 are used at one edge of the paper, they can be located face-to-face, or they can be offset so that they do not radiate directly at each other in the event the paper web 1910 tears or its edge 1912 is damaged or missing. Such direct counter-radiation can rapidly damage the burner faces, particularly if those faces are ceramic fiber mats, and to guard against such damage a photoelectric web edge detector can be located upstream from the burners and connected to shut off the flow of fuel to one or both burners when the edge 1912 is missing from the paper web.

A similar safeguard can be used to extinguish both burners when the paper web 1910 stops or slows down excessively. Even relatively low-temperature operation of the burners can rapidly scorch a stopped paper web.

Either or both burners 1900 can also be equipped with re-radiator panels. Where so equipped the assembly of one burner with its re-radiators can be placed directly opposite a similar second assembly but with each burner directly facing the re-radiator panel portion of the opposing assembly.

FIG. 30 also illustrates a desirable heating and drying combination of the present invention. Here a conveyor 1160, which can be of the belt or vibratory type, carries a layer of particles that are to be dried and/or heated. The layer first passes under infra-red generator 1170 which can have any of the gas-fired constructions described above or in the parent applications or can be of the ceramic tile or wire mesh type. After the infra-red generator, the particles pass under an array of tubes 1161 through which there is projected downwardly, spaced streams of heated gas. This gas comes from a manifold 1162 into which it is blown by a blower 1163. The intake of the blower is connected to two hoods, one shown at 1164 as extending along one side of burner 1170 and manifold 1162. The other hood extends similarly along the other side of those structures.

Hoods 1164 suck up the hot combustion gases generated by burner 1170, as well as the gases blown out of the bottoms of tubes 1161 after those gases have blown through the layer of particles. These sucked up gases can then be further heated by a burner upstream or downstream of blower 1163, and blown out against the layer of particles. However, if this blown out gas does not have to be as hot as, or hotter than, the hot combustion products from burner 1170, little or no auxiliary heating is needed in the sucking and blowing section. Where the blown gases cool too much in that section, a second burner 1170 can be added in front of the first burner so as to add more infra-red irradiation as well as extra heat for the blown gases.

It is not necessary to seal in the gas collection and recirculation path of the construction of FIG. 30. This simplifies the construction and the sucking in of a little extra air is no significant problem.

Tubes 1161 can have their lower ends tightly or loosely fitted through holes in a horizontally-extending deflector plate. Alternatively a tube construction as in U.S. Pat. No. 4,235,591 can be used with or without the hot gas recycling of that patent. Even the blowing arrangement of U.S. Pat. No. 3,239,863, designed for dust removal, can be used to effectively blow heated gas over substrates to dry them.

FIG. 31 shows a heat-treating arrangement using an air jet arrangement to assist the heating. Here a wet paper web 1650 is passed under a gas-fired infra-red generator 1652 that can be of the air-seal or non-air-seal type and fires face down. To the downstream end of the burner is secured a box 1654, generally rectangular in cross section that can extend the full width of the burner in the direction transverse to the web movement. The downstream end of the box is closed or partially closed by an air jet duct 1656 that can be moved up and down as indicated by the double-headed arrow 1658. The lower end of the jet duct is tapered to a narrow jet nozzle 1660 that fits in and coacts with a downwardly-directed venturi 1662 whose upper end 1664 opens into box 1654, and whose lower end includes a diverter angle 1666 that splits downwardly jetted air into two streams, one directed down and upstream of the web, the other down and downstream of the web.

Box 1654 has its lower wall 1668 perforated and secured to the lower surface of that wall is a re-radiating ceramic fiber panel 1670. That panel can seal against the venturi to close off the bottom of box 1654. The top wall of the box does not reach quite as far as the jet duct 1656, leaving a gap 1672 that can be covered to varying degrees by a slide 1674.

In operation the burner is fired by a combustion mixture fed into it at arrow 1676. The hot combusted gases accumulate below the burner face and move toward the box 1654 as indicated at 1678. Air blown into jet duct 1656 as indicated at 1680 aspirated the gaseous contents of box 1654 out through the venturi 1662, thus lowering the pressure in the box and sucking the hot gaseous combustion products into the box through re-radiator panel 1670. The aspirated box contents are accordingly hot combustion products diluted with some ambient air as determined by the position of slide 1672. The jetted air also mixes with the aspirated air, and this mixture can be further adjusted by raising and lowering the jet ducts. Lowering that duct to its lower limit can bring it in contact with the venturi throat and thus essentially completely block the aspiration.

The direction of web movement can be opposite to that shown in FIG. 31, if desired. Additionally or alternatively a second burner-jet combination can be mounted downstream of the first to supplement the web treatment.

FIG. 32 illustrates a modified drying arrangement 1838 for webs 1802 of paper or textile or the like that are wet with water or other volatilizable liquid. The structure of 1838 includes a gas-fired burner 1858 having a ceramic fiber matrix 1843 the outer face of which is generally parallel to a planar i-radiation zone 1844 along which web 1890 is guided by rollers 1839, 1840. The burner holds its matrix 1843 in the vertical plane, and above the burner is a porous re-radiator panel 1860 through which is sucked the hot combusted gas generated by the burner. Suction is applied from the intake 1853 of a blower 1854, and a side inlet 1852 open to a supply of ambient dry air but controlled as by damper 1851, is connected to mix such ambient air with the hot gases sucked through re-radiator 1860.

Blower 1854 propels through outlet 1855 the gases drawn through inlet 1853 and pushes those propelled gases at a pressure of at least 10 psig through a discharge slot 1847 shown as formed by a sheet metal box 1856. The slot 1847 should be about 3 to about 6 millimeters wide and should extend across the entire width of web 1891, so that it delivers a thin air curtain jet of recirculated gas directed at a speed of at least about 10 feet per second along the web surface being irradiated.

The jet should not be discharged more than about 5 millimeters from the web surface, so that the outer wall 1848 of the metal forming the jet should be quite thin—not over about 1 millimeter. This permits that wall to be spaced a few millimeters from the web. The jet can be directed parallel to the web, or it can be directed toward the web by up to about 5 degrees.

In order to reduce the burbling caused by the venturi effect of the jet, wall 1848 can have a number of small perforations that permit gas to flow at low speed from the interior of the jet forming box into the space 1846 between the web and wall 1848.

Also an additional gas discharge 1845 from blower 1854 can be directed at relatively low speed toward the web from a distance of 1 to 3 millimeters. This causes gas streams to flow both upward and downward along the web, as shown by arrows 1848, 1849. Stream 1848 also helps reduce the mixing effect of the venturi formed by jet 1847. Jet 1847 can alternatively be angled a bit so that it is directed toward the web 1891, rather than parallel to it. Thus box 1856 can be spaced about 5 to about 7 centimeters from the web, with its slot directed about 20° from parallel so that it gradually reaches the web and continues along the web in an essentially laminar flow.

By making the distance from the jet discharge to the upper end of the irradiation zone not over about 50 centimeters, the jetted air curtain will accomplish two results. It will not only rapidly flush away the vapor laden gas layer formed at the web surface by the heating effect of the irradiation, but will also keep its curtain nature and not intermix too much with the combusted gases generated by the burner. The curtain can then be collected in an exhaust box 1859 at the far end of the irradiation zone, and discharged at a location where the vapor it picks up is not returned to the web.

The temperature of the air curtain gas should not be so high as to damage the web. Where the web is paper, that temperature should be not over about 400° F. Some webs made of resin fibers will be damaged if the jet temparature is above 250° F., but high temperature webs such as those made of kevlar can withstand 450° F. jets. The jet temperature is easily controlled by adjusting damper 1851 to mix more or less cold ambient air with the recirculating hot gases.

Burner 1842 is shown as an air-seal type burner as in FIG. 1, with marginal hold-down flanges 1857 holding matrix 1843 in place. A non-air-seal type burner such as that of FIG. 18 can alternatively be used, so that no significant amount of metal is exposed to the combustion zone. Where metal is so exposed at the upper end of the burner, such metal can be covered as by extending panel 1860 downwardly to overlie the metal.

All of the 1838 equipment can be mounted on a single metal channel or plate 1858. Resilient separators as at 1882 can be inserted between adjacent metal structures that are at different temperatures in use, to reduce thermal stresses upon heat-up and cool-down.

Web 1891 can be traversed across the irradiation zone in an upward or downward or even sidewise direction. Several units 1838 can be used to treat a web, either in cascade as in FIG. 26 or in tandem to irradiate both web faces. The units can also be tilted away from the vertical.

Thus as shown in FIG. 33, a web can be threaded up and over a top roller 1888 and then down, to provide two runs 1890, 1892 against each of which an irradiating unit is installed. This triangular web run uses only a single roller 1888 that is not in line with a main set of rollers 1894, 1896, and is therefore desirable. Such a triangular arrangement is also suitable as a modification for the construction of FIG. 24, or for other treatment applications.

The construction of FIG. 32 can be varied as by eliminating the sucking of the hot combusted gases through a porous re-radiator panel. Such a variation is partly illustrated in FIG. 34. Here a web of wet paper 1990 or the like is irradiated by an irradiation unit 1938 that includes a gas-fired infra-red generator 1942 and a re-radiator panel, as well as means for sweeping a stream of gas from a jet discharge 1947 to an outlet 1988. Generator 1942 can be constructed like generator 1842 in FIG. 32, and panel 1960 can be made of porous or non-porous ceramic fiber construction.

The gases emerging from outlet 1988 can be recycled by blowing them through jet 1947, preferably after they are cooled somewhat as by mixing with ambient air. Panel 1960 has its irradiating surface facing web 1990 heated by the hot combusted burner gases that move past that surface toward the outlet 1988.

The ceramic fiber matrixes for the various burner constructions of the present invention are generally long enough to span the entire width of a web that is to be irradiated, even if that web is 200 inches wide in the cross-machine direction. For web widths over about 78 inches, the matrixes are preferably pieced together as described in U.S. Pat. No. 4,224,018.

In the machine direction, the matrixes have generally been relatively short. Thus in an air-seal burner as illustrated in FIG. 1, the matrix might only have 11 inches of its machine-direction span heated to incandescence. The matrix itself could measure a total of about 14 inches in the machine direction, but 3 of those inches are covered by hold-down angles or are devoted to air-seal air discharge. The burners of the present invention preferably provide incandescent spans as large as 15 inches in the machine direction. Where a 15 inch radiant span is provided in a burner such as that of FIG. 1, the overall span of the matrix could be 3 inches greater.

About 1½ to 2 inches of the matrix's machine direction span can be devoted to a pilot compartment as illustrated in FIGS. 9 and 10. Thus in an arrangement of the type illustrated in FIG. 26, each burner can have a two-inch wide pilot combustion compartment extending across the entire cross-machine direction of the burner. A flame monitor can then be mounted at one end of the burner in alignment with the pilot compartment and oriented to respond to incandescence or flame on the matrix portion covering the cross-machine center of the pilot compartment.

The pilot compartment is more conveniently ignited as by the electric ignition of FIGS. 9 and 10, than an entire burner, and the monitor will then serve to make sure the pilot compartment is operating. In the event the monitor fails to show such operation, it automatically shuts down the entire burner, as a safety measure. However so long as the pilot compartment operates, it can be controlled to always remain operating, whether the burner is turned up to its maximum output, or turned down or out. In such an operation the pilot compartment is arranged to be turned down to provide very little radiation, so that even though it remains operating when the balance of the burner is shut off, it will not ignite a paper web for example that may be stopped facing the operating compartment. When the burner is turned on after being turned off, the pilot compartment which can be kept on all the time will ignite the burner's combustion mixture.

To place a burner in operation, only the pilot compartment need be started, and since the pilot compartment is much smaller than the combustion mixture plenum, the start-up takes less time. Start-up also generally involves a discharge of excess combustion mixture, and such excess is much smaller for the pilot compartment than for the entire burner.

If desired the pilot compartment can be continually maintained in operation at a very low level, whether the burner itself is turned up high or turned down low. Although this reduces the maximum radiation available from the burner, the burner controls are simplified and interruption delays reduced. Also burners are almost never used at their maximum output, and for a burner with a 15 inch radiant length in the machine direction, a 1.5 inch pilot compartment length in that direction is very minor.

The foregoing modification of FIG. 26 can be further modified as shown in FIG. 35. Here substrate 2000 being irradiated is not very porous, paper for example, and the irradiating structure 2002 is carried by an encircling frame 2004 the interior of which can be lined with thermal insulation. The frame is open at its top and bottom, and holds a set of four burners 2011, 2012, 2013 and 2014 as well as a set of porous re-radiator panels 2021, 2022, 2023 and 2024. The burners and panels are offset from each other so that burners do not fire at each other in the event the substrate is not in place. Piping supplies combustion mixture and the like, and draws off combustion products through the reradiator panels, but is not illustrated.

In FIG. 35 the substrate is carried through the frame from left to right, through an entrance slot 2008 and an exit slot 2009. Just before it reaches the exit slot it is subjected to gas jet curtains from jets 2031, 2032 which are directed toward the substrate and about 40 to 50 degrees upstream. This jet curtain treatment keeps the gases in the irradiation zone 2019 from escaping in any significant amounts through exit slot 2009, and can also by the jet action help suck ambient air through that slot from outside frame 2004.

The top and bottom of frame 2004 is completely filled by the burners and re-radiator panels so that the only other opening into the irradiation zone is the substrate receiving slot 2008. Vapors including solvent vapors are accordingly kept from leaking out, and any such solvent can then be recovered or burned. In order to permit simple threading of the substrate through the frame, one or both sidewalls of the frame can have side slots about 2 to 4 inches high that extend along those sidewalls and are closed as by hinged doors. Through their side slots a person's fingers can be inserted to grip and move the substrate through from entrance slot 2008 to exit slot 2009.

The apparatus of FIG. 35 is also equipped with fire-extinguishing means to prevent the spreading of a fire on the substrate. A substrate such as paper may ignite and start to rapidly burn, as for example when a side edge tears and pushes itself against the incandescent face of a burner.

The fire extinguisher of FIG. 35 is a pair of snuffer bars 2041, 2042 of ceramic fiber held by air cylinders 2046 connected to be triggered by a flame detector to push the snuffer bars against opposite faces of the substrate to thus snuff out any fire on the moving or stationary substrate. It may be desirable to locate the snuffing zone well downstream of exit slot 2009 to make sure a detected fire does not get past the snuffing zone before the snuffer is operated.

A similar fire extinguisher can be provided near the substrate entrance slot 2008 to keep fires from travelling upstream on the substrate.

Fire extinguishing action is improved by having jets 2031, 2032 arranged to jet gas at a velocity high enough to blow out most flames, and particularly where the gas so jetted contains little or no oxygen. Such gas can be obtained from the gas withdrawn through the re-radiator panels, particularly where the burners are operated with a combustion mixture at or slightly richer than stoichiometric, and when so-called air-seal burners are used, the air for the air seals is replaced by or diluted with recycled combusted gas.

The burner matrixes are preferably impregnated with about 1% dimethylsilicone water-proofing oil, as described in Ser. No. 592,793, to make them resistant to the action of streams of water that may reach them when they are not in use and equipment is being hosed down. Also the matrixes can be made to operate with more uniform incandescence if they are molded from fiber slurries containing at least about 0.2% dispersing agent such as the non-ionic alkylphenylpolyethoxyethanols. The use of a fiber binder such as rubber that cures to a hydrophobic product is also helpful.

Obviously many modifications and variations of the present invention are possible in light of the above teachings. It is therefore to be understood that within the scope of the appended claims the invention may be practiced otherwise than as specifically described.

What is claimed:

1. In combination, an infra-red irradiator that generates infra-red energy at a temperature high enough to ignite a substrate being irradiated, the irradiator having an irradiation zone through which an elongated ignitable substrate web is conducted in one direction to be irradiated as the web moves, web-guiding means positioned to guide the moving substrate sheet through a path into, through and out of the irradiation zone, and solid snuffer means in the guide path downstream of the irradiation zone to keep fire on the substrate from moving past the snuffer, the snuffer means having a pair of opposed snuffer bars positioned adjacent to but spaced from the respective faces of the guided substrate, and an actuating mechanism connected for moving the snuffer bars toward each other to engage both faces of the web between them and thus cut off the movement of fire downstream of the web.

2. The combination of claim 1 in which the snuffer bar surfaces that engage the substrate are of ceramic fibers.

3. The combination of claim 1 in which there is a second snuffer in the guide path upstream of the irradiation zone to prevent the upstream movement of substrate fire.

4. The combination of claim 1 in which the irradiation zone is in an essentially closed compartment apart from a web inlet and outlet, and adjacent said outlet the compartment contains gas discharge jets directed to blow toward the guide path streams of gas containing little or no oxygen to help extinguish any fire on the substrate as it moves to said outlet.

* * * * *